US005749664A

United States Patent [19]

Inoue et al.

[11] Patent Number: 5,749,664

[45] Date of Patent: May 12, 1998

[54] COSMETIC CONTAINER HAVING AN INSERT SLEEVE TO IMPROVE AIR TIGHTNESS AND ROTATIONAL CHARACTERISTICS

[75] Inventors: Takashi Inoue, Fujisawa; Kenichi Ito, Funabashi; Tetsuo Kobayashi, Nagareyama; Hirobumi Matayoshi, Toride; Masahisa Koyama, Tsukuba; Hideo Fujita, Kashiwa, all of Japan

[73] Assignee: Hidan Co., Chiba, Japan

[21] Appl. No.: 499,146

[22] Filed: Jul. 7, 1995

[30] Foreign Application Priority Data

Jul. 8, 1994 [JP] Japan ..... 6-179659
Mar. 31, 1995 [JP] Japan ..... 7-097517

[51] Int. Cl.[6] ..... B43K 21/08; B43K 23/00

[52] U.S. Cl. ..... 401/78; 401/88

[58] Field of Search ..... 401/78, 77, 75, 401/74, 69, 49, 52, 88, 98, 116, DIG. 1

[56] References Cited

U.S. PATENT DOCUMENTS

| | | | |
|---|---|---|---|
| 3,310,168 | 3/1967 | Landen | 401/78 X |
| 4,208,144 | 6/1980 | Idec et al. | 401/78 X |
| 4,417,827 | 11/1983 | Kasai et al. | 401/77 X |
| 4,579,134 | 4/1986 | Moore | 401/78 X |
| 4,603,989 | 8/1986 | Ackerman et al. | 401/78 |
| 5,000,601 | 3/1991 | Wruck | 401/78 |
| 5,597,252 | 1/1997 | Ito et al. | 401/78 |

FOREIGN PATENT DOCUMENTS

| | | | |
|---|---|---|---|
| 834749 | 3/1938 | France | 401/78 |
| 1016910 | 10/1957 | Germany | 401/78 |
| 2169045 | 7/1986 | United Kingdom | 401/98 |
| 2244475 | 12/1991 | United Kingdom | 401/78 |

*Primary Examiner*—D. Neal Muir
*Attorney, Agent, or Firm*—Marshall & Melhorn

[57] ABSTRACT

An outer body surrounds a main body and is rotatable with respect to the main body to move up and down a cosmetic holder received in the main body. An insert sleeve is coupled integrally to the upper end portion of the outer body, by welding, integral-forming or any other suitable coupling device. The main body has an annular projection on its outer peripheral surface, which rotatably and elastically contacts with a lower portion of the insert sleeve. In an embodiment, the insert sleeve has a downwardly extending tongue which may be deformed elastically and contact with the projection of the main body. The projection is spaced apart from the outer body.

26 Claims, 25 Drawing Sheets

COSMETIC CONTAINER HAVING AN INSERT SLEEVE TO IMPROVE AIR TIGHTNESS AND ROTATIONAL CHARACTERISTICS

BACKGROUND OF THE INVENTION

1. Field of the Invention

The present invention relates to a cosmetic container for receiving a stick-like cosmetic such as a lipstick, which can smoothly extract and retract a stick-like cosmetic such as a lipstick accommodated therein.

2. Description of the Prior Art

As a main body of a conventional cosmetic container, a cylindrical body formed by pressing a flat plate, namely a so-called pressing pipe, has been used. However, a great number of steps are required for manufacturing the pressing pipe, and it is difficult to make the cylindrical body to have a cross-section of a complete circle. Therefore, in order to reduce the number of the manufacturing steps, to improve dimensional precision of the main body, and to smoothen extraction and retraction of the cosmetic relative to the container, it has become the recent practice that a straight pipe formed by drawing is used as the main body.

FIG. 36 shows an example of a prior art cosmetic container using a straight pipe as a main body.

As shown in FIG. 36, within a decorative casing 200 having an upper open end, a main body 201 composed of a straight pipe formed by drawing is arranged co-axially and relatively rotatably therewith. There is a space between the casing 200 and the main body 201. A cylindrical outer body 205 provided with a continuous spiral groove 207 on an inner peripheral surface thereof is arranged between the casing 200 and the main body 201. The outer body 205 is integrally fitted to the bore of the casing 200. An insert sleeve 203 is permanently fitted to the upper end portion of the outer body 205 to rotatably surround the main body 201. Within the main body 201, a cosmetic holder 209 for receiving and holding a cosmetic is received. Diametrical projections 211, 211 opposed to each other are provided at the lower end portion of the holder 209. These projections 211, 211 pass through elongated slots 213, 213 provided in the lower portion of the main body 201 to engage with the spiral groove 207. On the outer periphery of the center portion of the main body 201 is formed a projecting bead 215 which is engaged with an internal recess 206 of the outer body 205 to prevent removal or separation of the main body 201. Reference numeral 216 indicates a cap for detachably closing the upper open end of the casing 200.

In use, by rotating an integral assembly comprising the casing 200, the outer body 205 and the insert sleeve 203, the projections 211, 211 in engagement with the spiral groove 207 are guided along the slots 213, 213 of the main body 201 to move up and down, to achieve extraction and retraction of the cosmetic holder 209.

In such a conventional cosmetic container, the outer body 205 is in contact with the main body 201, and the insert sleeve 203 is in contact with the outer body 205 and the main body 201, respectively.

However, a straight pipe manufactured by drawing inevitably has a certain degree of diametrical dimensional errors. The extraction and retraction property of the cosmetic container is greatly governed by frictional resistance between the main body 201 and the outer body 205, especially at the abutment portion at which the bead 215 is engaged within the recess 206. The frictional resistance would, in turn, vary depending upon dimensional relationship between the main body 201, the outer body 205 and the insert sleeve 203.

For example, when a diameter of the insert sleeve 203 is relatively small to exert an excessive degree of the frictional resistance between the main body 201 and the outer body 205, the cosmetic holder 209 cannot be smoothly moved.

When a diameter of the insert sleeve 203 is relatively large, the frictional resistance between the main body 201 and the outer body 205 in the abutment portion is decreased. In this case, the cosmetic holder 209 can be moved too easily, and a user would have difficulty in the cosmetic retracting and extracting operation. Further, airtightness of the container is degraded, and there is a possibility of deteriorating the cosmetic by an invasion of the open air.

In another prior art, a lubricant such as silicon grease is applied to the contracts between the respective constituents of the container in order to smoothen extraction and retraction of the cosmetic. However, use of silicon grease is not desirable, because the cosmetic tends to deteriorate under the influence of components of the silicon grease during the long-term use.

It is lately in fashion to use a cosmetic hard to melt away, a moist cosmetic, etc.. However, cosmetic of such a type has a relatively large content of a volatile substance. Therefore, unless the container provides a good airtightness, the cosmetic would be deteriorated. Further, when the airtightness of the container is not excellent, after the cosmetic is accommodated, so-called "slip-out" (a phenomenon that the cosmetic is contracted and consequently slipped out of the cosmetic holder); "desertion" (a phenomenon that the cosmetic cannot effectively cope with movement of the cosmetic holder); and "breakage" (a phenomenon that the cosmetic is contracted and consequently becomes easy to break). In order to prevent such phenomena, airtightness of the container becomes a critical requirement.

SUMMARY OF THE INVENTION

It is therefore an object of the present to provide a cosmetic container capable of smoothly moving a cosmetic without use of any lubricant.

Another object of the present invention is to improve airtightness in a cosmetic container especially using a straight pipe as a main body. With an improved airtightness, if the container is used for a cosmetic containing many volatile components, it can be used for a long time without generation of such phenomena as "slip-out", "desertion" and "breakage".

Still another object of the present invention is to provide a novel construction capable of preventing disadvantages which would otherwise be caused by inevitable dimensional errors in manufacturing cylindrical or tubular members constituting the cosmetic container.

Still another object of the present invention is to provide a novel construction capable of preventing disadvantages which would otherwise be caused by inevitable dimensional errors in manufacturing cylindrical or tubular members constituting the cosmetic container.

Still another object of the present invention is to reduce the number of constituents of the cosmetic container.

In order to achieve these and other objects, according to an aspect of the present invention, there is provided a cosmetic container comprising: a main body provided at a lower portion thereof with slot means extending in a longitudinal direction; an outer body provided at a lower portion thereof with slot means extending in a longitudinal direction; an outer body provided with a continuous spiral groove on an inner peripheral surface thereof, the outer body surrounding the main body substantially in close relation to each other but allowing relative rotation therebetween; a cosmetic holder accommodated within the main body substantially in close relation to each other but allowing relative longitudinal sliding movement therebetween, the cosmetic holder being provided with projection means projecting outwardly therefrom through the slot means to be in engagement with the continuous spiral groove so that the cosmetic holder moves longitudinally with respect to the main body in response to rotation of the outer body; an insert sleeve surrounding the main body and arranged fixedly with respect to the outer body; the main body being provided on an outer peripheral surface thereof with an annular projection which contacts with a bottom portion of the insert sleeve and is spaced apart from an inner peripheral surface of the upper end portion of the outer body.

The insert sleeve may have an annular rib on an inner peripheral surface thereof. The annual rib contacts with an outer peripheral surface of the main body and providing a gap between the insert sleeve and the main body.

The annular rib may be formed as a series of spaced dot-like projections or an endless continuously extending rib.

The cosmetic holder may have an oval cross-section.

The cosmetic holder may be provided on an outer peripheral surface thereof with a pair of opposed projections extending in a longitudinal direction. The projections may extend from below the annular projection of the main body to a bottom end of the cosmetic holder.

The insert sleeve may be provided on an outer peripheral surface thereof with an annular projection for detachably engaging with an annular recess formed on an inner peripheral surface of a cap.

The insert sleeve may have a longitudinal wall slit.

A cap may be detachably fitted to said main body.

An inner cap may be fitted within a cap. The insert sleeve is provided on an outer peripheral surface thereof with an annular projection for detachably engaging with an annular recess formed on an inner peripheral surface of the inner cap.

An inner cap, fitted within a cap, may be detachably fitted to the main body.

The insert sleeve may be welded to the upper end portion of the outer body. The insert sleeve may be formed as an integral part of the outer body.

In accordance with another aspect of the present invention, there is provided a cosmetic container comprising: a main body provided at a lower portion thereof with slot means extending in a longitudinal direction; an outer body provided with a continuous spiral groove on an inner peripheral surface thereof, the outer body surrounding the main body substantially in close relation to each other but allowing relative rotation therebetween; a cosmetic holder accommodated within the main body substantially in close relation to each other but allowing relative longitudinal sliding movement therebetween, the cosmetic holder being provided with projection means projecting outwardly therefrom through the slot means to be in engagement with the continuous spiral groove so that the cosmetic holder moves longitudinally with respect to the main body in response to rotation of the outer body; an insert sleeve surrounding the main body and arranged unrotatably with respect to the outer body; an inner peripheral surface of the upper end portion of the outer body being partly cut out to form at least a cutout portion; the insert sleeve having an integral downwardly extending tongue positioned inside of the cutout portion with a gap therebetween, the tongue contacting elastically with an annular projection formed on an outer peripheral surface of the main body.

The tongue may be in linear contact with the annular projection of the main body.

The tongue may be formed as an endless ring or a ring with longitudinal slit or slits.

The insert sleeve may be provided on an inner peripheral surface thereof an annular rib for rotatably contacting with the main body. The annular rib may be an endless continuous projection or formed as a series of spaced dot-like projections.

A ring member may further be disposed below the tongue. In this case, both the ring member and the tongue surround and elastically contact with the annular projection of the main body.

The ring member is preferably made of elastic material.

The ring member may have a cutout portion to facilitate its elastic deformation.

The insert sleeve may be welded to the upper end portion of the outer body, or formed as an integral part of the outer body.

BRIEF DESCRIPTION OF THE DRAWINGS

The above and further objects and advantages of the present invention will become apparent to those skilled in the art upon reading of the following description and by reference to the accompanying drawings in which.

DETAILED DESCRIPTION OF THE PREFERRED EMBODIMENTS

Figure 1A:
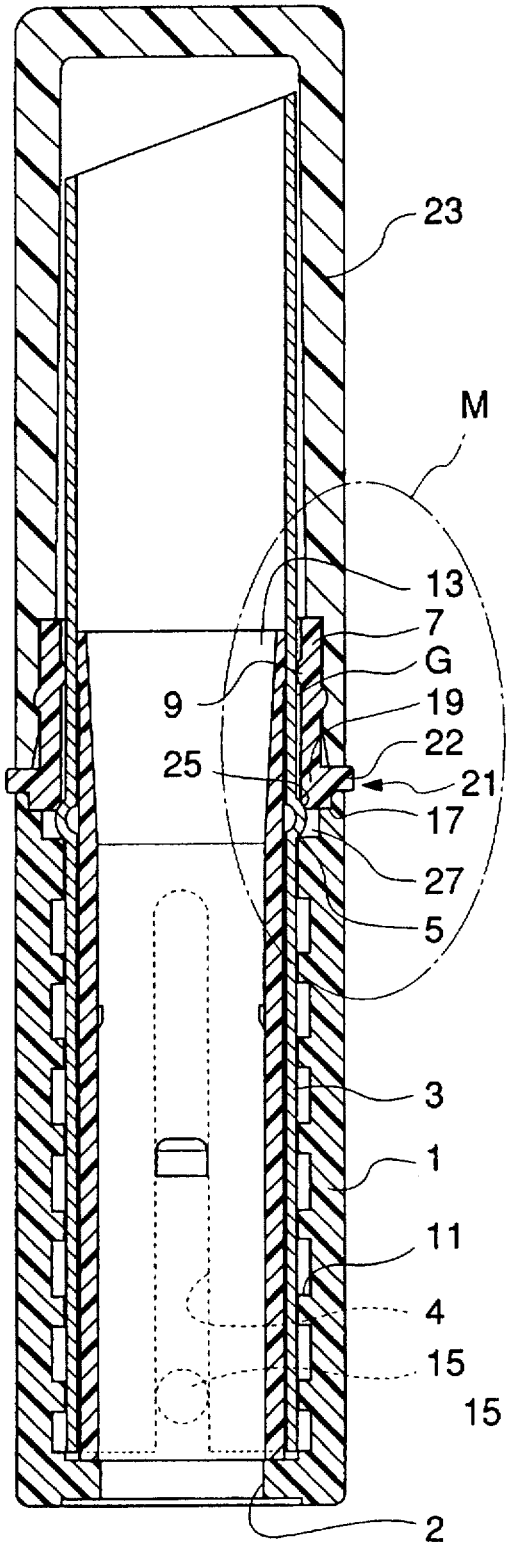
FIGS. 1A and 1B are longitudinal cross-sectional views showing an embodiment of a cosmetic container according to the present invention.
Figure 1B:
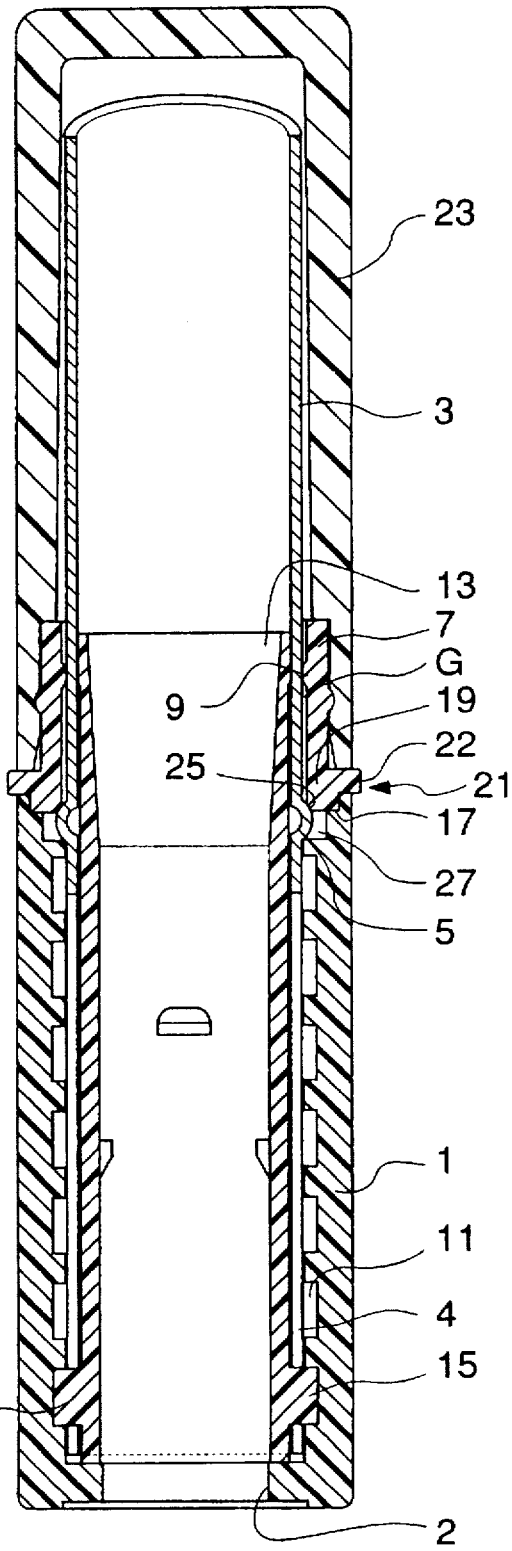
Figure 2:
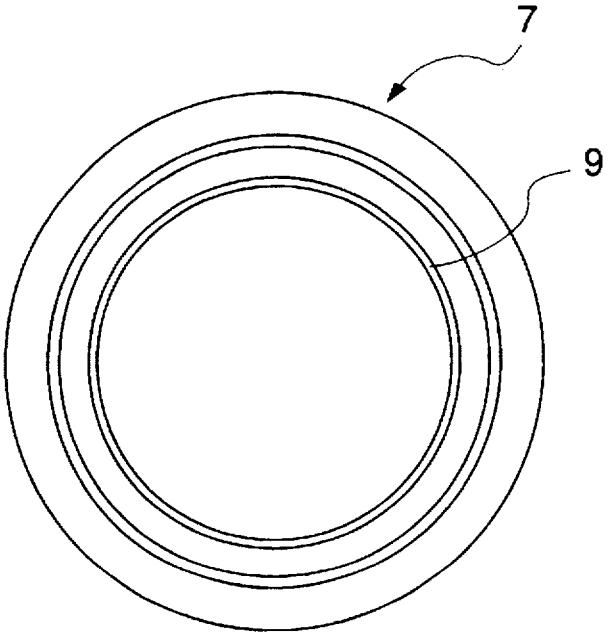
FIG. 2 is a plan view of an example of an inner sleeve used in the cosmetic container of FIG. 1.

A preferred embodiment of the present invention will be hereinunder described with reference to FIGS. 1 and 2. FIGS. 1A and 1B are cross-sectional views taken along vertical planes perpendicular to each other.

A cosmetic container of the illustrated embodiment includes a cylindrical outer body 1 having an upper open end and an aperture 2 at the bottom, and a main body 3 coaxially arranged and received within outer body 1 with some diametrical gap G therebetween. Main body 3 having upper and lower open ends is made of a straight pipe formed by drawing, etc. A pair of elongated slots 4 are provided in symmetrical location of a lower portion of main body 3. Main body 3 has a center portion having a circumferentially external bead 5. Main body 3 has the same diameter except bead 5. Outer body 1 may be rotated with respect to main body 3, while preventing separation therebetween.

An inner sleeve 7 is a tubular body having upper and lower open ends. Insert sleeve 7 is located between outer body 1 and main body 3. More particularly, the lower end portion of insert sleeve 7 is welded to the upper end portion of outer body 1. Thus, outer body 1 and insert sleeve 7 are assembled in one united body and in use moved in unison.

An elevatable cosmetic holder 13 is encapsulated by main body 3 for receiving a stick-like cosmetic 37. On an outer peripheral surface of cosmetic holder 13 at a lower end thereof, there is integrally formed a pair of opposed projections 15, 15 which projects outwardly to pass through slots 4 and engages with a spiral groove 11 formed on an inner peripheral surface of outer body 1. Spiral groove 11 is located beneath bead 5.

Figure 3:
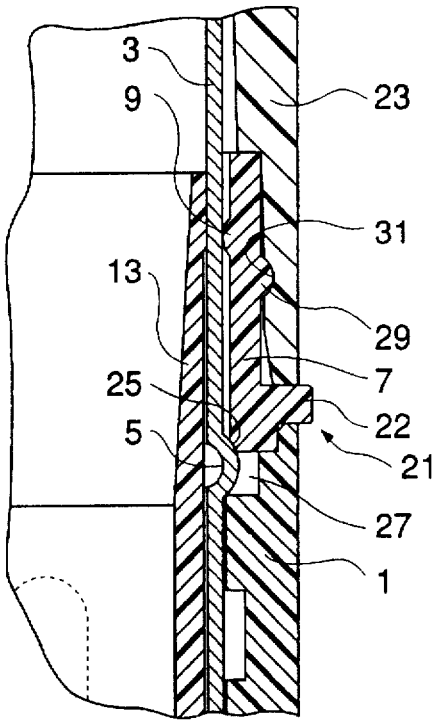
FIG. 3 is an enlarged view showing an M portion in FIG. 1.

In further reference to FIG. 3, it is to be understood that outer body 1 has a relatively thick wall, which allows formation of stairs 17 on the inner peripheral surface at the upper end portion. The stairs 17 are formed proximate to bead 5 of main body 3. The lower end of insert sleeve 7 is formed in conformity to the upper end portion of outer body 1. Accordingly, a welding area between these two elements 1 and 7 is considerably increased and they are stably and fixedly welded to each other by ultrasonic-welding or high-frequency-welding, for example. The welded portion 21 elastically contacts with bead 5 at a lower cut-out surface 25 of insert sleeve 7. The lower portion 19 of insert sleeve 7 extends outwardly to form a flange 22 which is interposed between cap 23 and the top of outer body 1. The innermost or lowermost stair provides a space 27 from bead 5.

Insert sleeve 7, which is integrally welded to outer body 1, is in rotatable contact with the outer peripheral surface of main body 3 via an annular rib 9 projecting inwardly from the inner peripheral wall of insert sleeve 7. Rib 9 provides a gap G between main body 3 and insert sleeve 7. Rib 9 may be an endless continuous one as shown in FIG. 2. Rib 9 may also be formed as a series of spaced dot-like projections.

In this embodiment, outer body 1, insert sleeve 7 and cap 23 are made of polypropylene (PP), cosmetic holder 13 is made of thermoplastic resin such as polybutylene terephthalate (PBT) and main body 3 is made of metal such as aluminum, for example.

Cap 23 is fitted onto tube 7. As shown in FIG. 3, the outer peripheral surface of insert sleeve 7 has an annular projection 29, which is positioned below rib 9 in a longitudinal direction. The inner peripheral surface of cap 23 has a corresponding annular groove 31. Engagement between projection 29 and groove 31 provides a detachable mounting of cap 23.

With the above-described cosmetic container, by forming stairs 17 to enlarge the welding area between insert sleeve 7 and outer body 1, insert sleeve 7 stands in a predetermined stable posture. This prevents inadvertent removal of main body 3.

The cosmetic container of the present invention does not employ a casing (200 in FIG. 38), which means reduction of the number of constituents of the cosmetic container and facilitates assembly.

Outer body 1 and insert sleeve 7 are welded to each other to form a united one body having a sufficient strength and stability. Annular rib 9 provides gap G between tube 7 and main body 3. Possible inaccuracy or disagreement in diameters of cylindrical elements caused by manufacturing errors could be well absorbed within gap G, thereby maintaining appropriate sliding resistance between main body 3 and insert sleeve 7 at abutment bead 5. Furthermore, rib 9 provides point-to-point or linear contact with the outer peripheral surface of main body 3. Accordingly, frictional resistance between inset sleeve 7 and main body 3 is relatively small and provides a good retraction/extraction property of the cosmetic container.

In the above-mentioned embodiment, various modifications can be made. For example, detachable coupling means between insert sleeve 7 and cap 23 may be modified as shown in FIG. 4 to FIG. 8, respectively.

Figure 4:
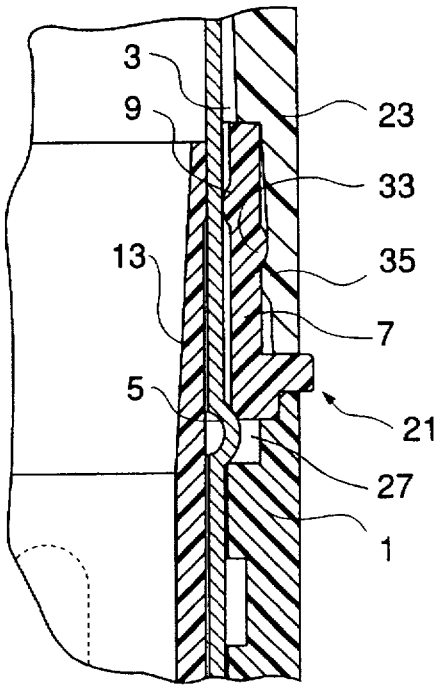
FIG. 4 is an enlarged view showing M portion of a modified embodiment.

In the embodiment shown in FIG. 4, the outer peripheral surface of insert sleeve 7 has, at a location below rib 9, an annular projection 33 which is engageable with an annular projection 35 formed on the inner peripheral surface of cap 23.

Figure 5:
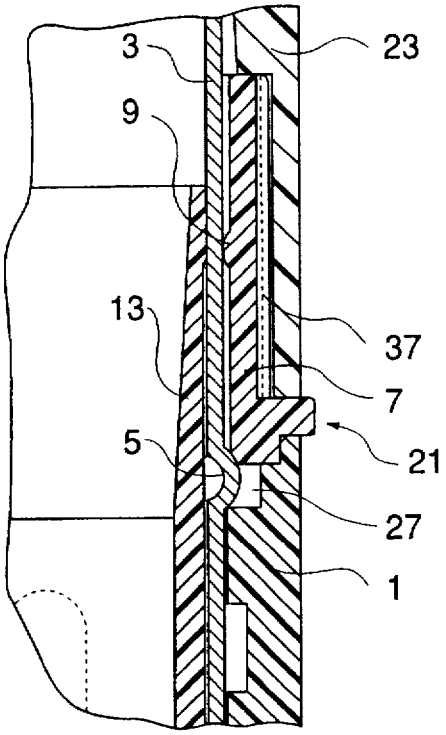
FIG. 5 is an enlarged view showing M portion of a still modified embodiment.

In the embodiment shown in FIG. 5, the outer peripheral surface of insert sleeve 7 has a longitudinally extending slit 37. Due to slit 37, insert sleeve 7 acts like a spring and shrinks in its diameter when cap 23 is press-fitted thereonto.

Figure 6:
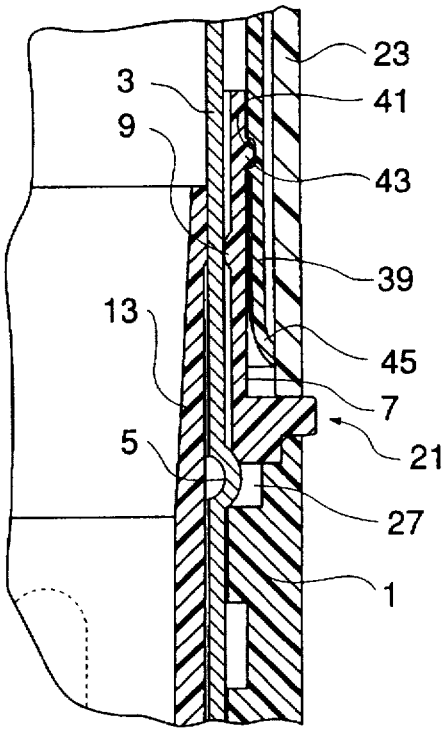
FIG. 6 is an enlarged view showing M portion of a still modified embodiment.
Figure 7:
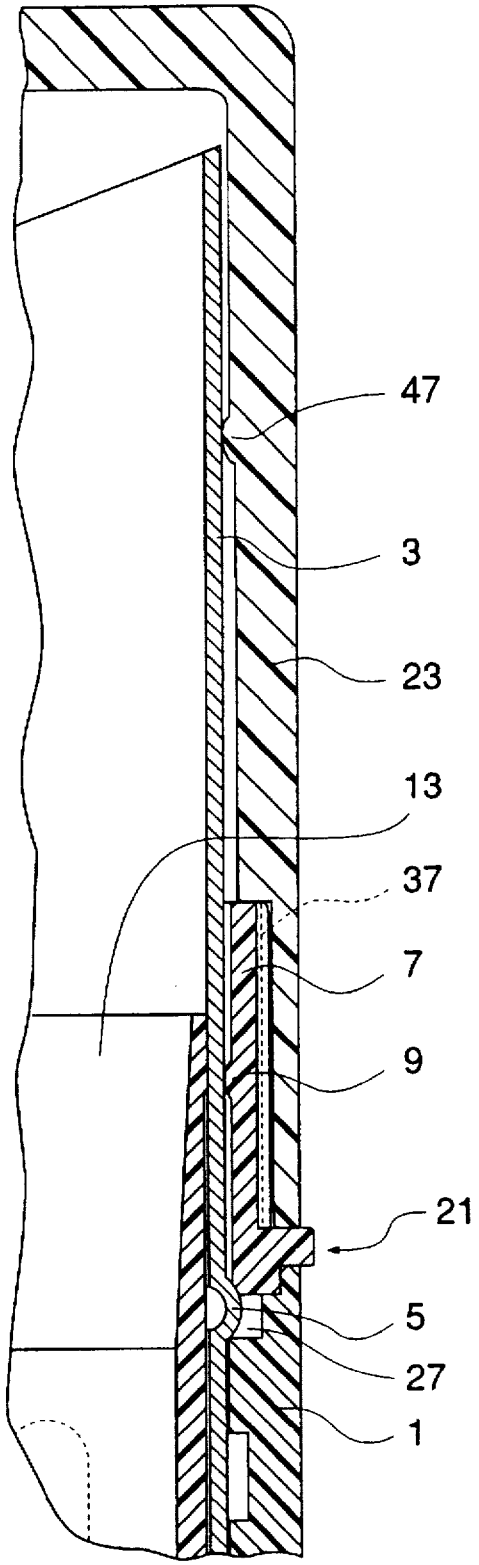
FIG. 7 is a longitudinal cross-sectional view showing still another embodiment.
Figure 8:
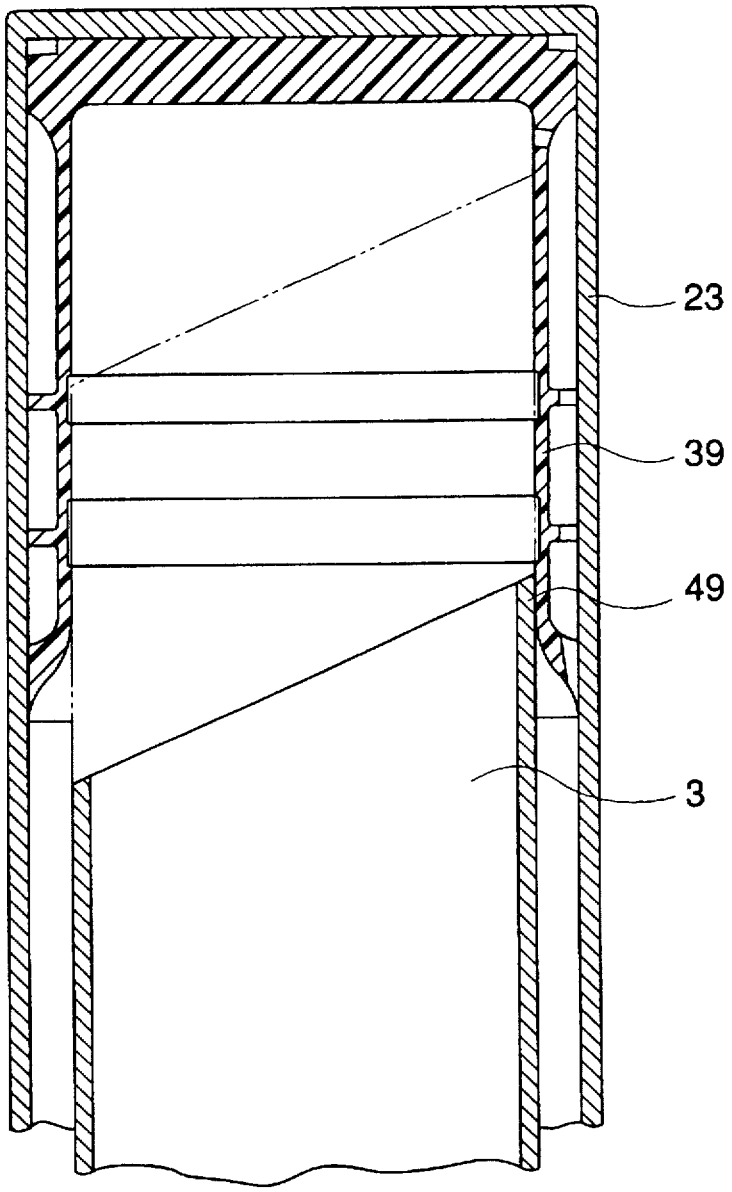
FIG. 8 is a longitudinal cross-sectional view showing an upper portion of still another embodiment.

FIGS. 6 to 8 show embodiment of a cosmetic container having an excellent airtightness. To maintain airtightness of the cosmetic container, bottom aperture 2 of outer body 1 is closed by a seal (not shown) made of resin or metal.

In the embodiment shown in FIG. 6, an inner cap 39 is fitted within cap 23. An annular projection 43 of the outer peripheral surface of insert sleeve 7 is engageable with an annular recess 41 of the inner peripheral surface of inner cap 39. The lower end portion 45 of inner cap 39 is enlarged to achieve smooth fitting and removal of cap assembly with respect to insert sleeve 7. Engagement between projection 43 and recess 41 are preferably positioned above rib 9 when the cap assembly is mounted.

In the embodiment shown in FIG. 7, the inner peripheral surface of cap 23 is provided with an annular projection 47 for contacting with the outer peripheral surface of main body 3. Insert sleeve 7 has a longitudinally extending slit 37 as in the embodiment of FIG. 5 to improve airtightness, even without use of an inner cap.

In the embodiment shown in FIG. 8, an inner cap 39 fitted within cap 23 is adapted to contact directly with the upper end portion of main body 3. By selecting dimensional relationship between cap 23 and insert sleeve 7 and/or by selecting material of these elements, the container of FIG. 8 may have improved airtightness.

Figure 9:
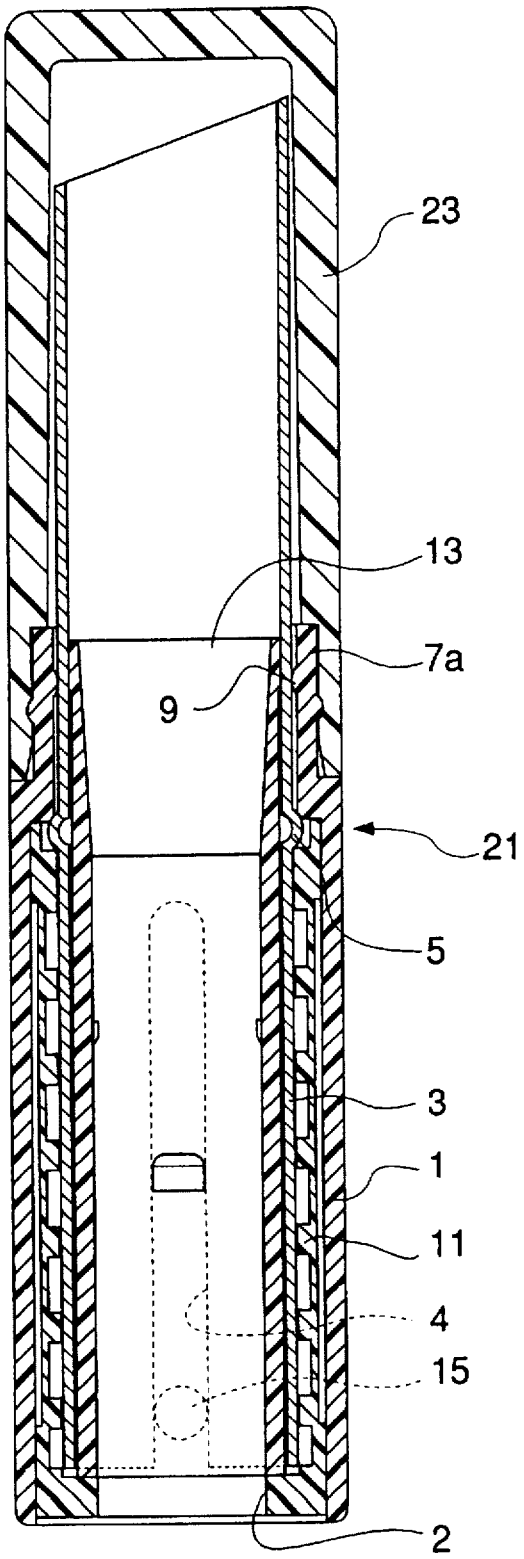
FIG. 9 is a longitudinal cross-sectional view showing still another embodiment.

As shown in FIG. 9, it is within a scope of the present invention that insert sleeve 7 and outer body 1 are formed integrally in one body. Reference numeral **7*a* indicates a portion corresponding to insert sleeve 7** in the previous embodiments.

Although the above-described embodiments show a cosmetic container of a bottom-filling type in which a molten cosmetic is filled into a mold located in cosmetic holder 13 though bottom aperture 2 of outer body 1, the present invention can be applied to a direct-filling type container in which a molten cosmetic is filled into cosmetic holder 13 through its upper open end. Also, the present invention is applicable to an insertion type container in which a solid cosmetic is inserted from above into cosmetic holder 13. In the case of a bottom- or direct-filling type container, the mold is removed and cap 23 is mounted after the cosmetic is solidified. In the case of a bottom-filling type container, after filling and solidifying the cosmetic, bottom aperture 2 is closed by a seal made of metal or resin to create airtight condition within the container.

Material from which the respective constituents of the cosmetic container may be made is not limited in the present invention. For example, outer body 1, insert sleeve 7 and cap 23 are made of acrylonitrile-styrene copolymer (AS resin), and cosmetic holder 13 is made of polypropylene (PP).

Main body 3 may be a pressing pipe formed by pressing a flat plate. However, it is preferable that main body 3 comprises a straight pipe formed by drawing.

Figure 10:
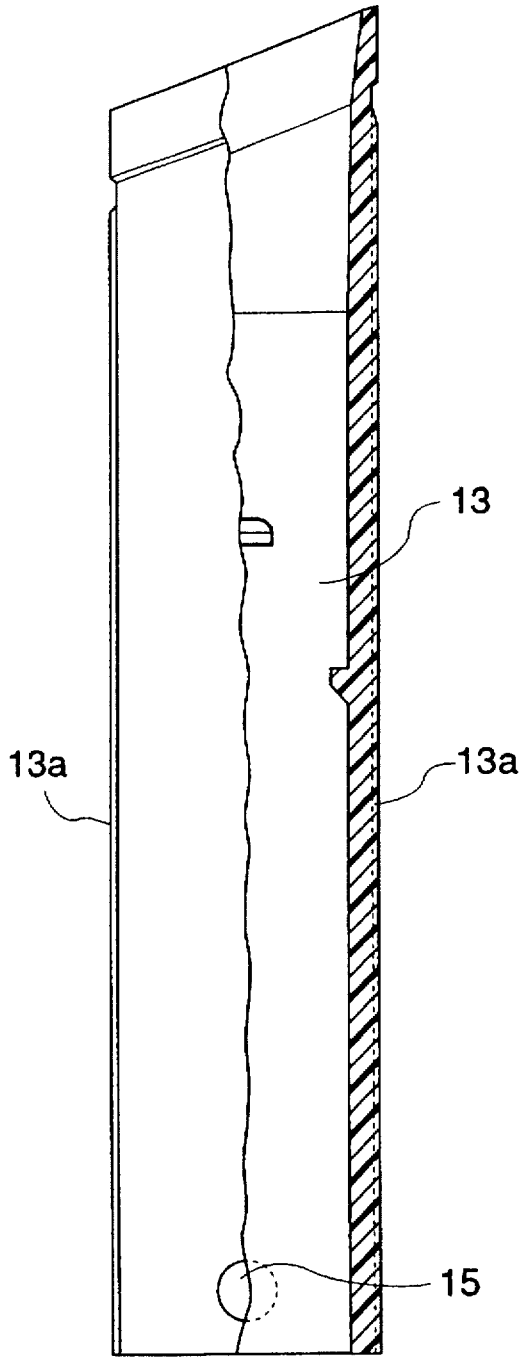
FIG. 10 is a longitudinal cross-sectional view showing still another embodiment of the cosmetic holder.
Figure 11:
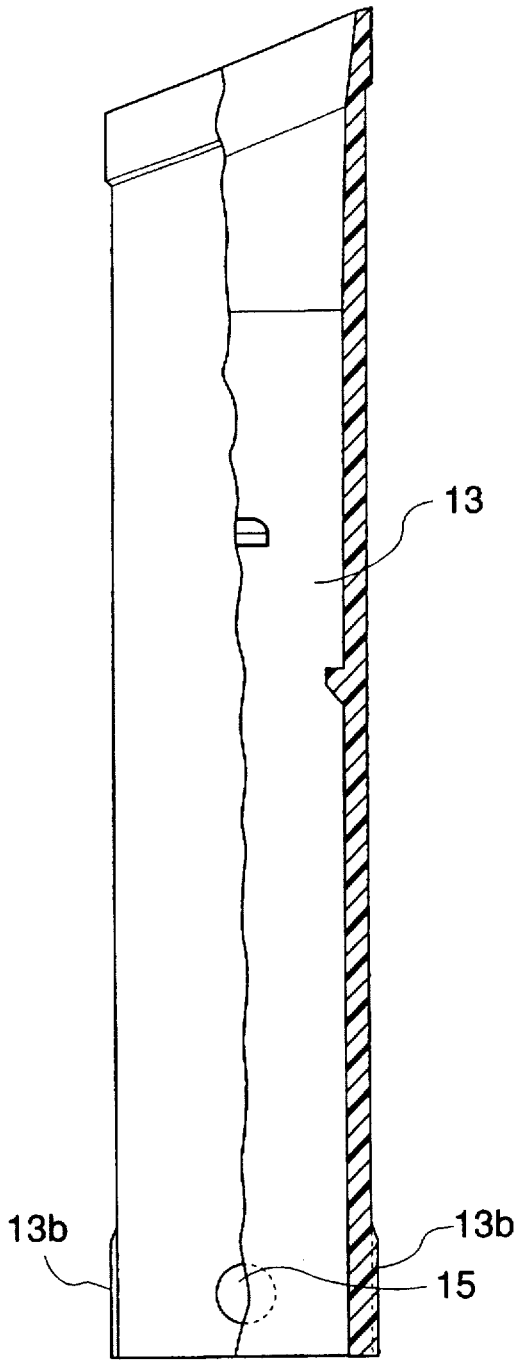
FIG. 11 is a longitudinal cross-sectional view showing still another embodiment of the cosmetic holder.

Cosmetic holder 13 may have a desired shape and form. For example, it may be an oval in cross-section. It may be provided with a pair of opposed projections **13*a*, 13*a* extending longitudinally along the outer peripheral surface thereof (FIG. 10). Alternatively, longitudinally extending projections may be positioned only at the lower end of cosmetic holder 13, which are shown as projections 13*b*, 13*b* in FIG. 11. In the embodiment of FIG. 11, insert sleeve 7 has a straight extending inner peripheral surface and is provided with no annular rib 9**.

Figure 12A:
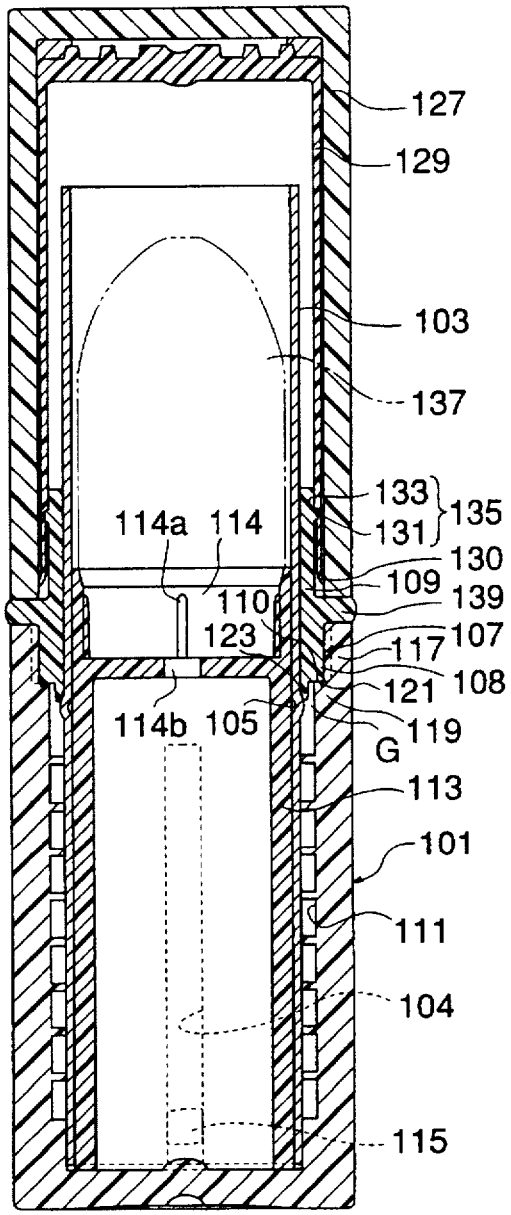
FIGS. 12A and 12B are longitudinal cross-sectional views showing the cosmetic container according to still another embodiment of the present invention.
Figure 12B:
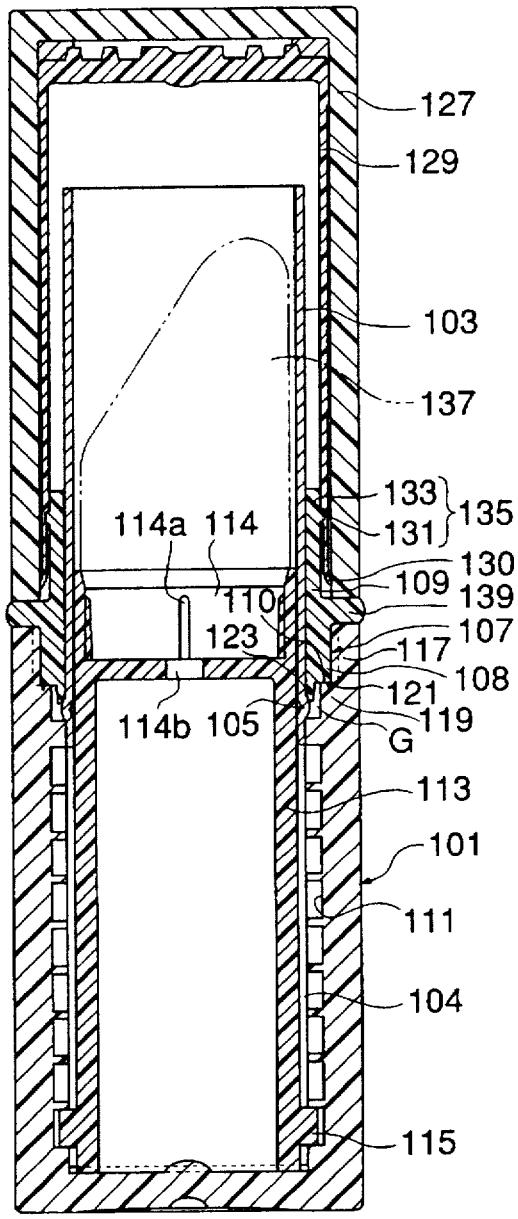
Figure 13:
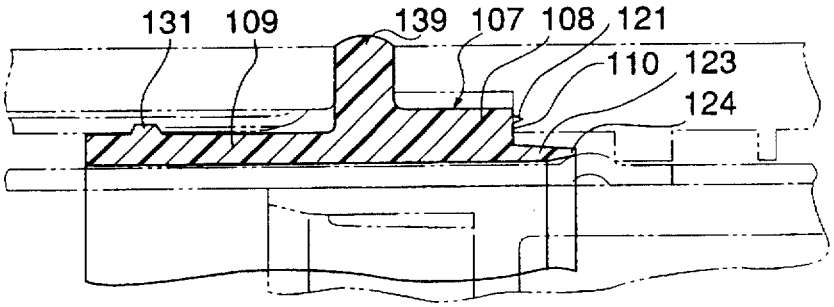
FIG. 13 is an enlarged cross-sectional view showing an embodiment of a tongue of the insert sleeve in the cosmetic container of FIG. 12.

Still another embodiment according to the present invention will be described with reference to FIG. 12. FIGS. 12A and 12B are cross-sectional views taken along vertical planes perpendicular to each other.

In a cosmetic container shown in FIG. 12, there is a cylindrical outer body 101 having an upper open end. A main body 103 is coaxially arranged and received within outer body 101 with some diametral gap G therebetween. Main body 103 having upper and lower open ends is made of a straight pipe formed by drawing etc. A pair of elongated slots 104 are provided in symmetrical location of a lower portion of main body 103. Main body 103 has a center portion having a circumferentially projecting external bead 105. Outer body 101 may be rotated with respect to main body 103, while preventing separation therebetween.

An insert sleeve 107 is a tubular body having upper and lower open ends. Insert sleeve 107 is located between outer body 101 and main body 103. More particularly, the lower end portion of insert sleeve 107 is welded to the upper end portion of outer body 101. Thus, outer body 101 and insert sleeve 107 are assembled in one united body and in use moved in unison.

An elevatable cosmetic holder 113 is encapsulated by main body 103. Cosmetic holder 113 has an upper receptacle portion 114 for receiving a stick-like cosmetic 137. On an outer peripheral surface of cosmetic holder at a lower end thereof, there is integrally formed a pair of opposed projections 115, 115 which projects outwardly to pass through slots 104 and engages with a continuous spiral groove 111 formed on an inner peripheral surface of outer body 101. Spiral groove 111 is located beneath bead 105. Reference numeral **114*a* indicates a vertically extending stripe projection on the inner peripheral surface of cosmetic holder 113. Reference numeral 114*b* indicates an aperture on the bottom of cosmetic holder 113**.

The inner peripheral surface of the upper end portion of outer body 101 is cut out to form an upper cutout portion 117 and a lower cutout portion 119. The lower portion 108 of insert sleeve 107 is interposed between upper cutout portion 117 and main body 103 and spot-welded to the former 117 at a welding position designated by a reference numeral 121.

Bead 105 of main body 103 is located just below a lower end tongue 123 of insert sleeve 107 and elastically and rotatably contacts thereto. Lower cutout portion 119 defines a gap G surrounding bead 105.

Figure 14:
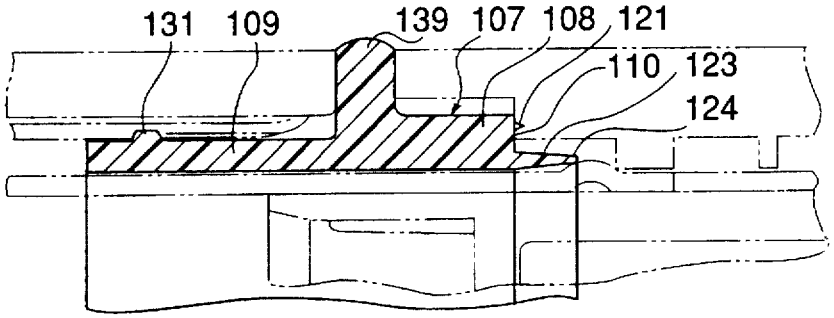
FIG. 14 is an enlarged cross-sectional view showing another embodiment of the tongue.
Figure 15:
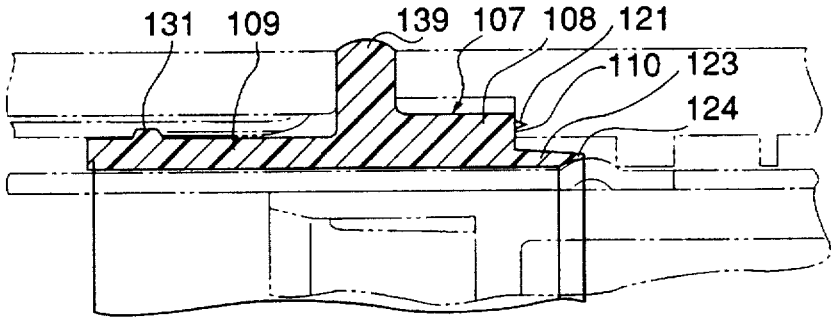
FIG. 15 is an enlarged cross-sectional view showing still another embodiment of the tongue.
Figure 16:
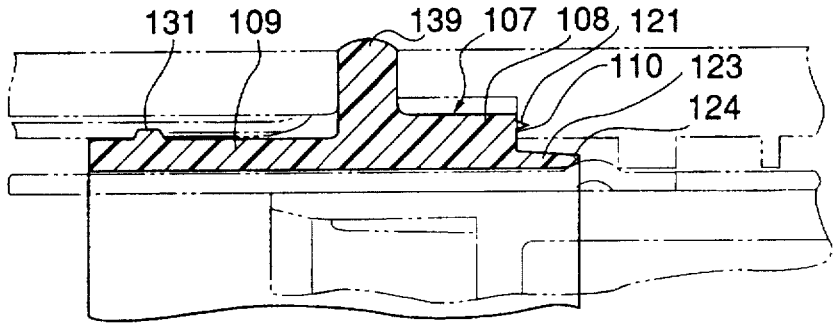
FIG. 16 is an enlarged cross-sectional view showing still another embodiment of the tongue.

Preferably, tongue 123 provides a linear contact with projection 105, as shown in FIGS. 13 to 16, to improve its spring effect and minimize an area of contact. In the embodiment shown in FIG. 13, tongue 123 has a tapered leading end portion 124 which contacts with bead 105. The entire portion of tongue 123 may be tapered, as shown in FIG. 14. Alternatively, leading end portion 124 of tongue 123 may be concave (FIG. 15) or convex (FIG. 16).

Figure 17:
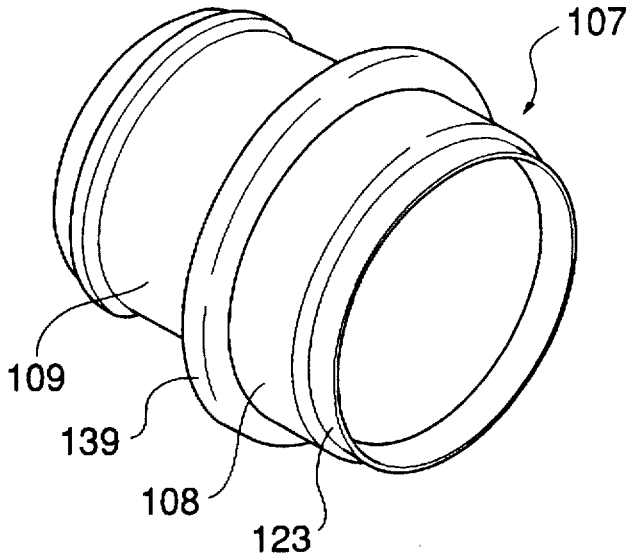
FIG. 17 is an enlarged perspective view showing still another embodiment of the tongue.
Figure 18:
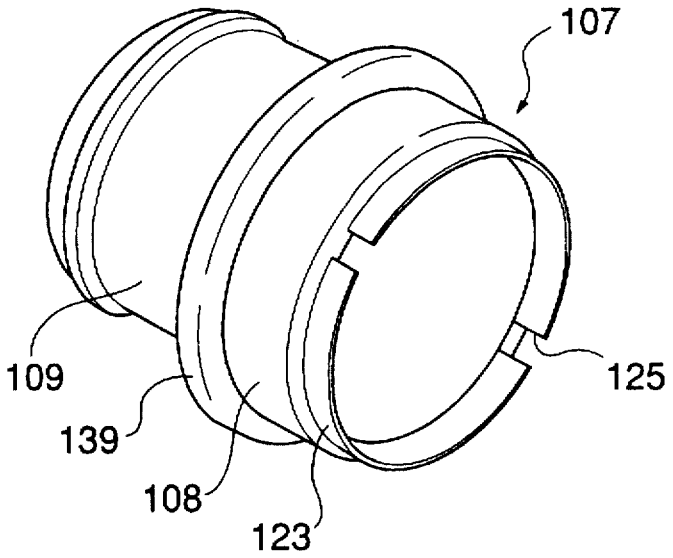
FIG. 18 is an enlarged cross-perspective view showing still another embodiment of the tongue.

Tongue 123 may be an endless, continuous ring (FIG. 17). Tongue 123 may have one or plural slits 125 to improve its spring effect (FIG. 18).

The upper portion 109 of insert sleeve 107 is airtightly interposed between main body 103 and inner cap 129 when cap 127 is fitted. The outer peripheral surface of the upper portion 109 has an annular bead or projection 131 for engagement with a recess 133 of inner cap 129. Thus, a detachable, airtight coupling means 135 between insert sleeve 107 and inner cap 129 comprises a combination of projection 131 and recess 133. The lower end 130 of inner cap 129 is enlarged to facilitate the fitting and removal of the cap assembly with respect to insert sleeve 107.

In this embodiment, a solidified stick-like cosmetic 137 is inserted into receptacle 114 from the above.

Reference numeral 139 indicates an outwardly projecting portion of insert sleeve 107, which provides a resilient action between casing 101 and cap 127.

By way of example, outer body 101, insert sleeve 107 and cap 127 are made of acrylonitrile stylene copolymer (AS resin), cosmetic holder 113 is made of polypropylene (PP), and inner cap 127 is made of polyethylene (PE). Main body 103 is made of metal such as aluminum.

Figure 33:
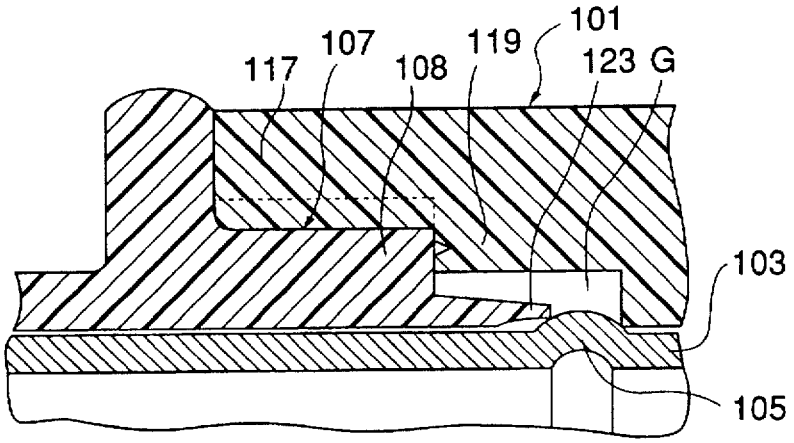
FIG. 33 through FIG. 35 are cross-sectional views for explaining the function of the cosmetic container of FIG. 32.
Figure 34:
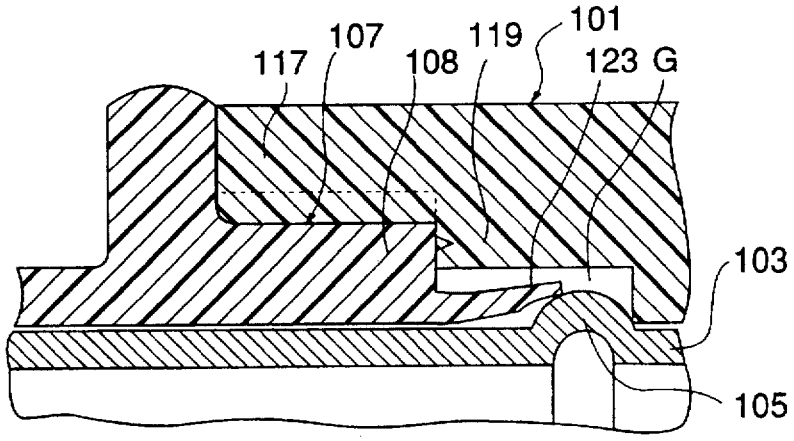
Figure 35:
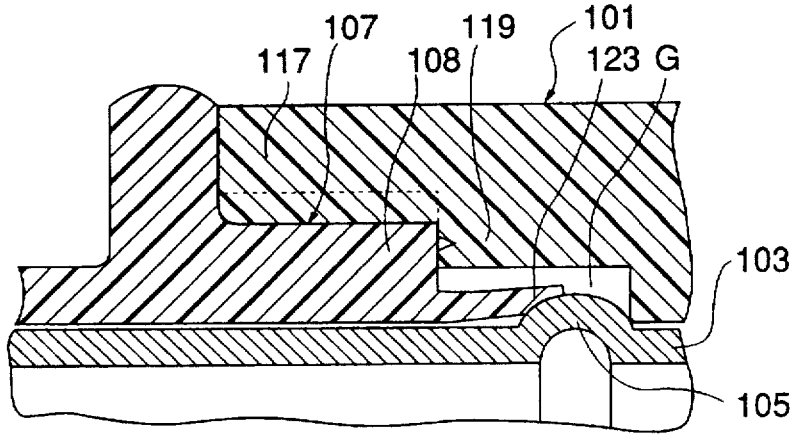
Figure 36:
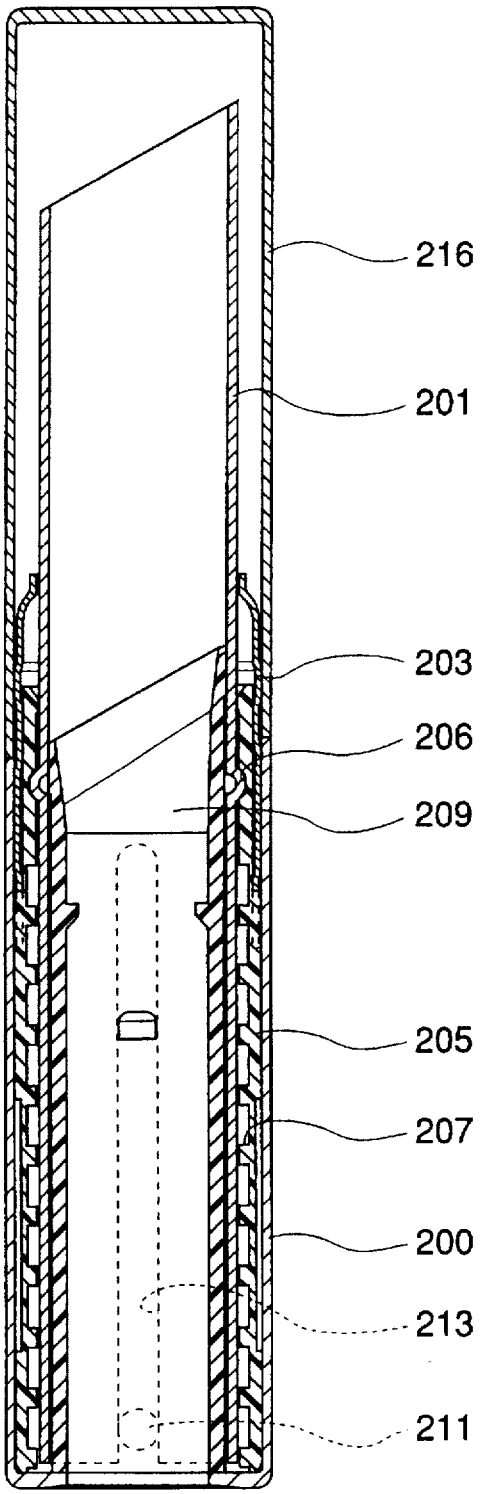
FIG.36 PRIOR ART
FIG. 36 is a longitudinal cross-sectional view showing a prior art cosmetic container.

With the above-described cosmetic container, tongue 123 of insert sleeve 107 acts like a spring with respect to bead 105 of main body 103. More particularly, when bead 105 is relatively small, as shown in FIG. 33, tongue 123 contacts with bead 105 in its natural form. When bead 105 projects more outwardly, tongue 123 is deformed to be spread out, as shown in FIG. 34. When bead 105 is wide in a longitudinal direction, as shown in FIG. 35, tongue 123 is deformed and contacts with bead 105 over an increased area of contact.

As above described, a major portion of insert sleeve 107 is arranged in a fixed manner, but its lower end tongue 123 can be freely deformed within gap G according to positional relationship between tongue 123 and bead 105. Such displacement between main body 103 and insert sleeve 107 could be caused by relative vertical movement therebetween during extraction and retraction of the cosmetic 137. Such displacement could also be caused by manufacturing errors. According to the present invention, such displacement is absorbed by the spring effect asserted by tongue 123, so that an optimum frictional resistance between main body 103 and outer body 101 at the abutment bead 105 can be maintained to provide a good extraction and retraction characteristics of the cosmetic container.

There is also an improved airtightness at the detachable coupling portion 135 between insert sleeve 107 and inner cap 127.

Figure 19A:
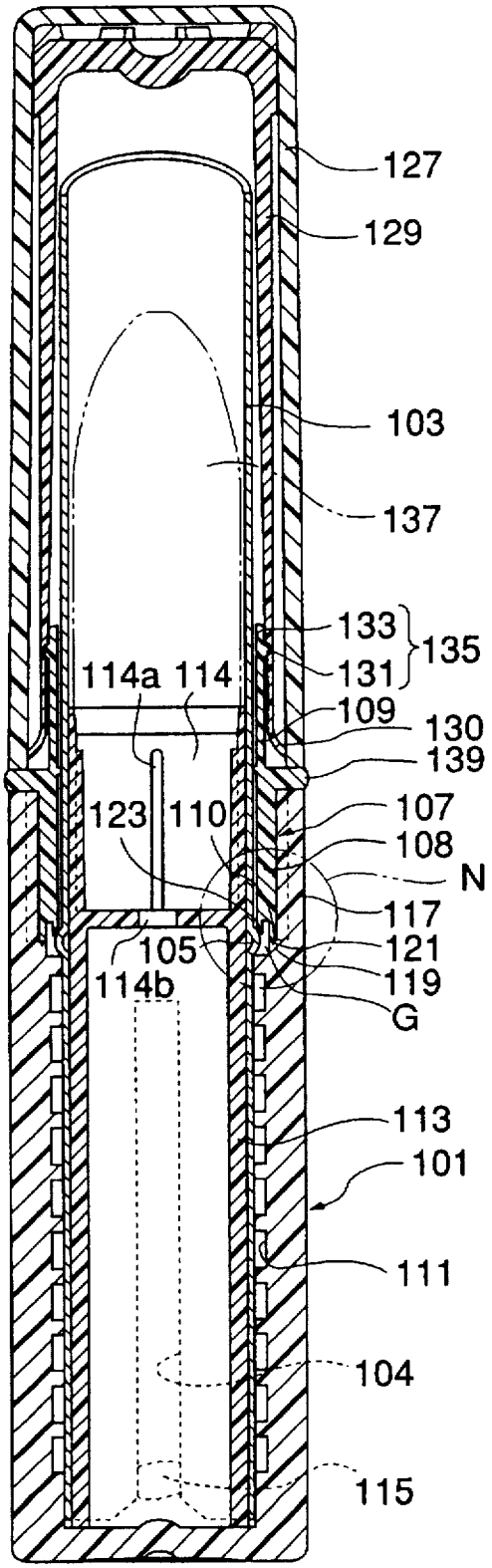
FIGS. 19A and 19B are longitudinal cross-sectional views showing the cosmetic container according to still another embodiment of the present invention.
Figure 19B:
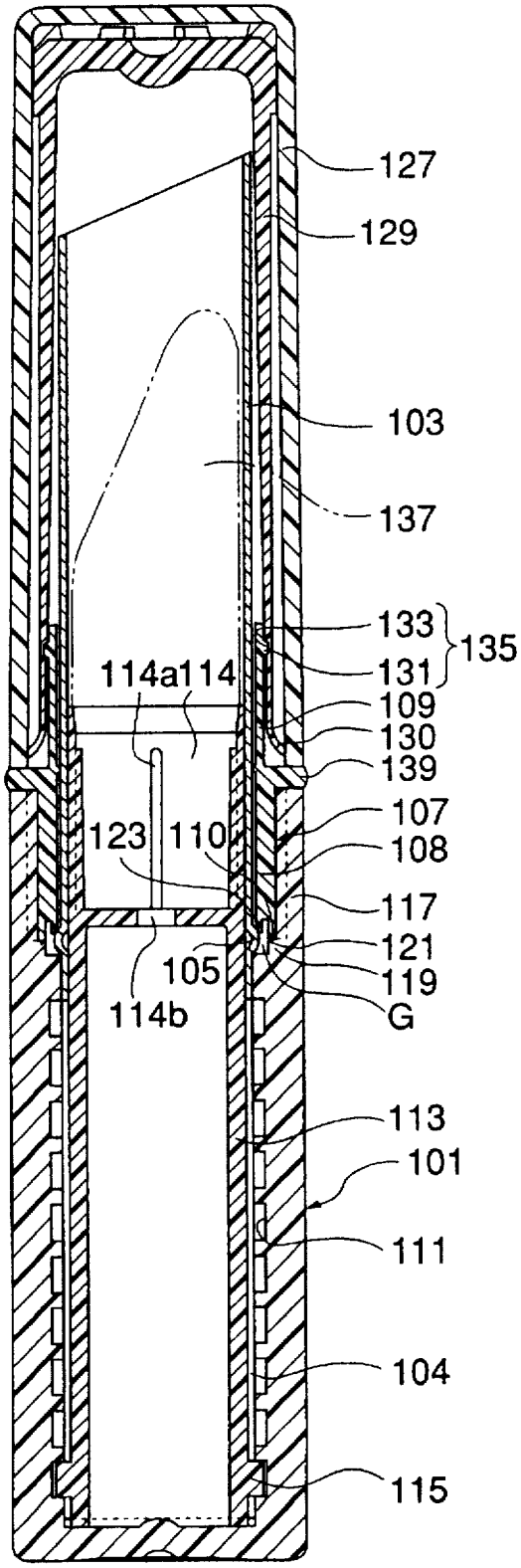
Figure 20:
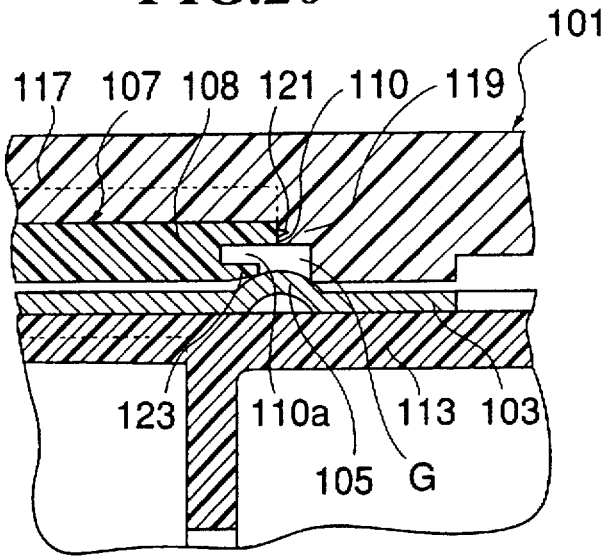
FIG. 20 is an enlarged view of an N portion in FIG. 19A.
Figure 21:
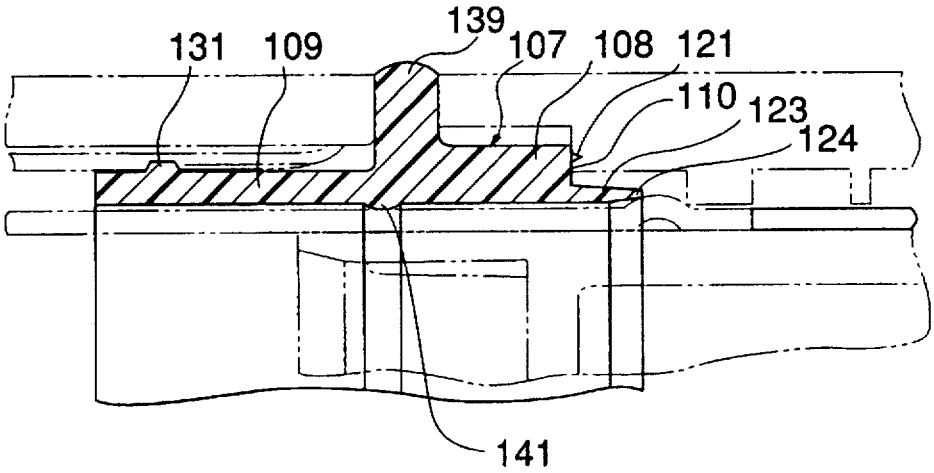
FIG. 21 is a cross-sectional view showing another embodiment of a cosmetic holder used in the cosmetic container of the present invention.

In the above-mentioned embodiment, various modifications can be made. For example, as shown in FIGS. 19 and 20, the lower end portion of insert sleeve 107 may be recessed to form an annular groove 110*a* which defines an inner remaining portion as tongue 123. This arrangement provides a favorable spring effect.

Insert sleeve 107 may have an annular rib or projection 141 for contacting with the outer peripheral surface of main body 103. In this embodiment, the lower portion 108 of insert sleeve 107 is in contact with the outer peripheral surface of main body 103 at two discrete positions, specifically at tongue 123 and projection 141.

Figure 22:
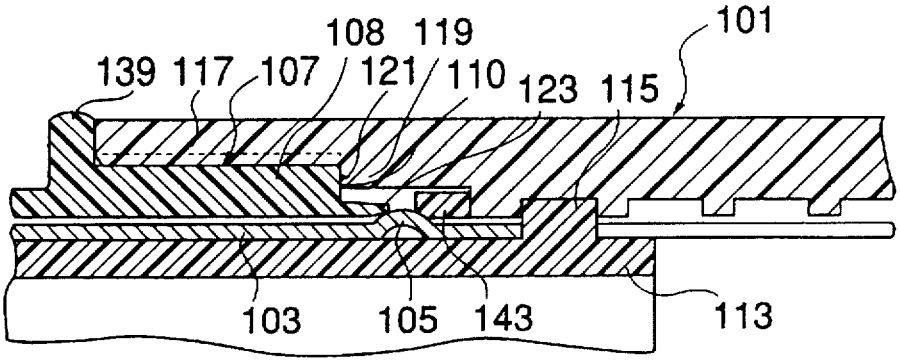
FIG. 22 is a cross-sectional view showing still another embodiment of the cosmetic container.
Figure 23:
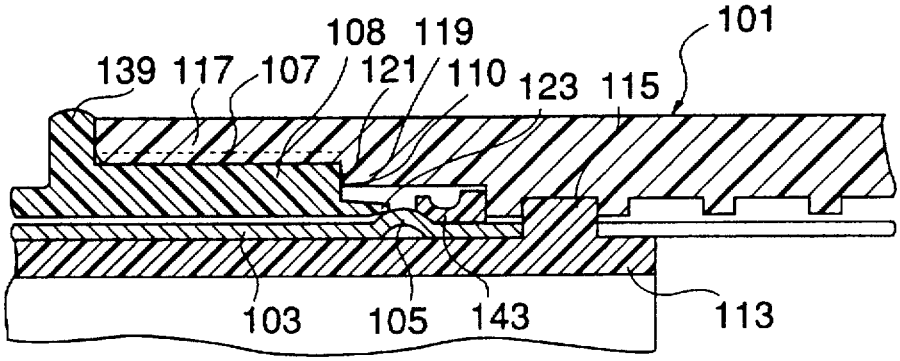
FIG. 23 is a cross-sectional view showing still another embodiment of the cosmetic container.
Figure 24:
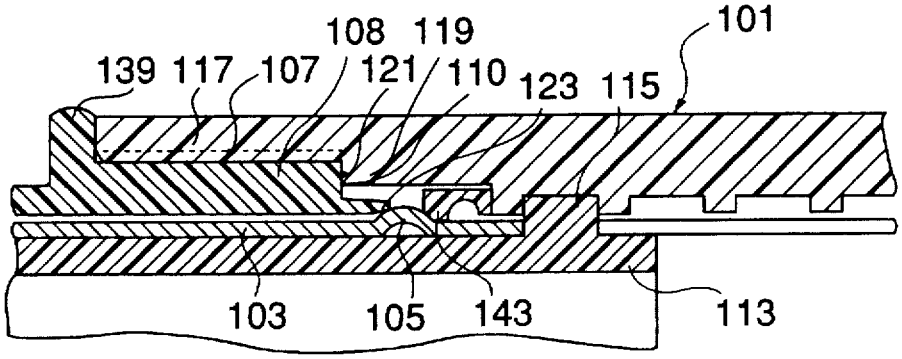
FIG. 24 is a cross-sectional view showing still another embodiment of the cosmetic container.
Figure 25:
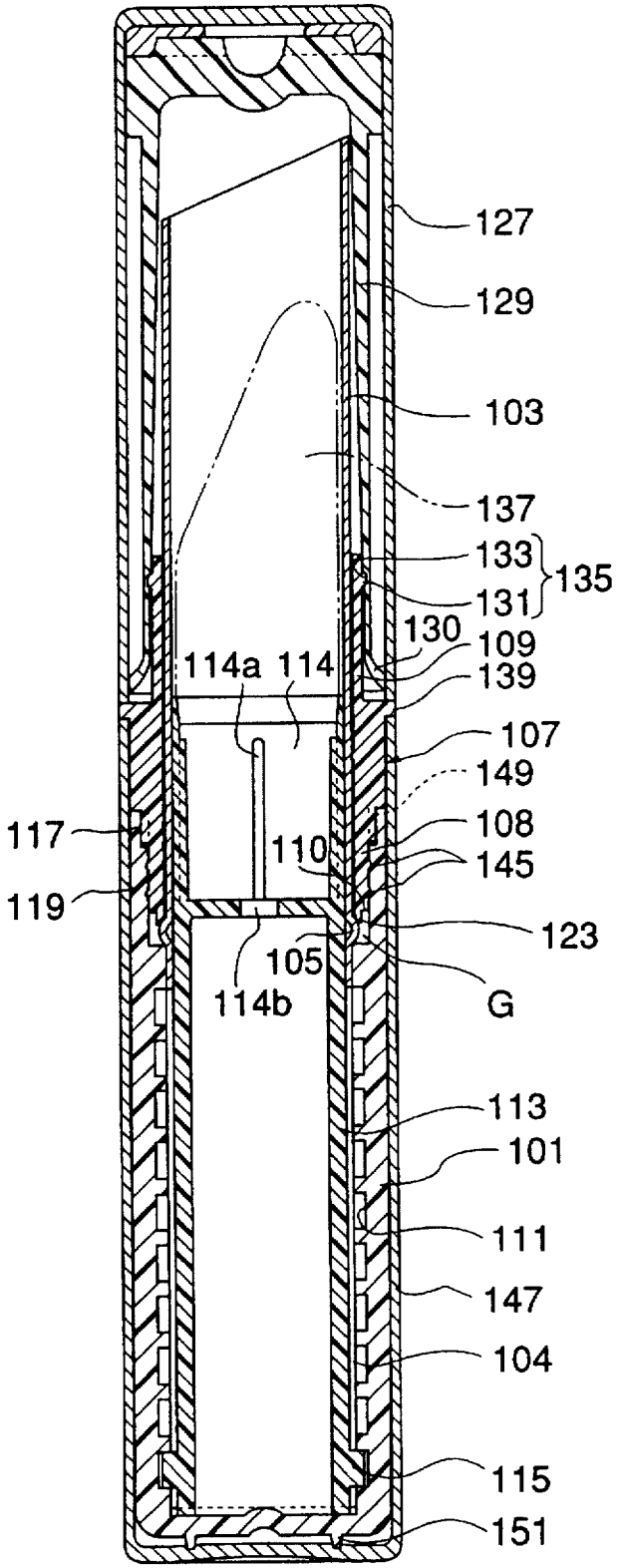
FIG. 25 is a longitudinal cross-sectional view showing still another embodiment of the cosmetic container.

FIGS. 22 and 24 show embodiments in which a ring 143 is disposed between lower cutout portion 119 of outer body 101 and bead 105 of main body 103, in opposition to tongue 123. Ring 143 is made of elastic material such as polyethylene (PE), polypropylene (PP) and polyacetal (POM). Ring 143 may have a desired shape, some examples of which are shown in FIGS. 22 to 24. Ring 143 in FIG. 22 is preferably made of polyethylene (PE) or polypropylene (PP) and ring 143 in FIG. 24 or FIG. 25 is preferably made of polyacetal (POM).

Figure 26:
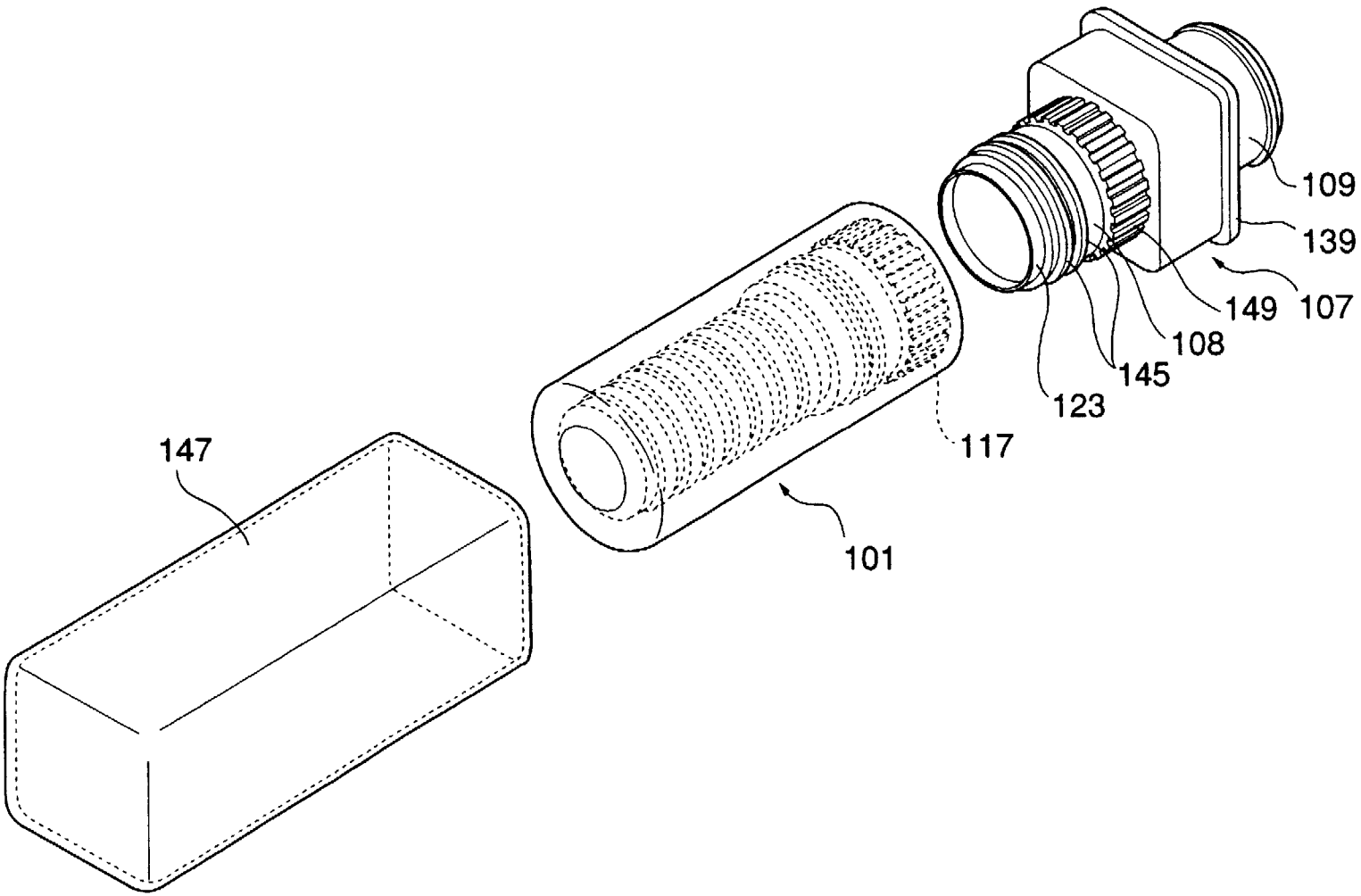
FIG. 26 is an exploded perspective view of the cosmetic container shown in FIG. 25.

Insert sleeve 107 is fixed integrally to outer body 101 by welding or any other suitable coupling means. FIG. 26 shows an embodiment in which the outer peripheral surface of the lower portion 108 of insert sleeve 108 has annular ribs or projections 145 for engagement with corresponding annular grooves formed on the inner peripheral surface of the lower cutout portion 119 of outer body 101. Further, as shown in FIG. 26, knurls 149 are formed on insert sleeve 107, which comes into engagement with corresponding grooves 117 formed on the inner peripheral surface of outer body 101, thereby preventing relative rotation between outer body 101 and insert sleeve 107.

In this embodiment, outer body 101 is fitted within a casing 147 while preventing relative rotation therebetween by inserting bottom projections 151 of outer body 101 into recesses on the bottom of casing 147. When casing 147 and cap 127 are made of metal such as aluminum, the container has improved airtightness. Inner cap 129 fitted within cap 127 also improves airtightness of the container.

Figure 27:
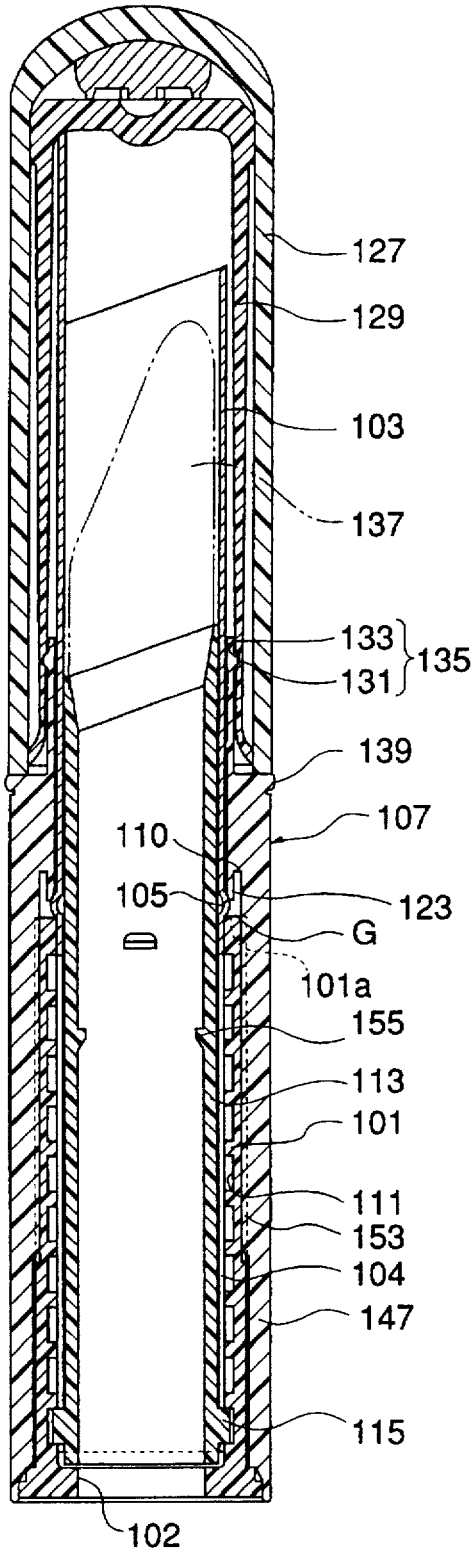
FIG. 27 is a longitudinal cross-sectional view showing still another embodiment of the cosmetic container.
Figure 28:
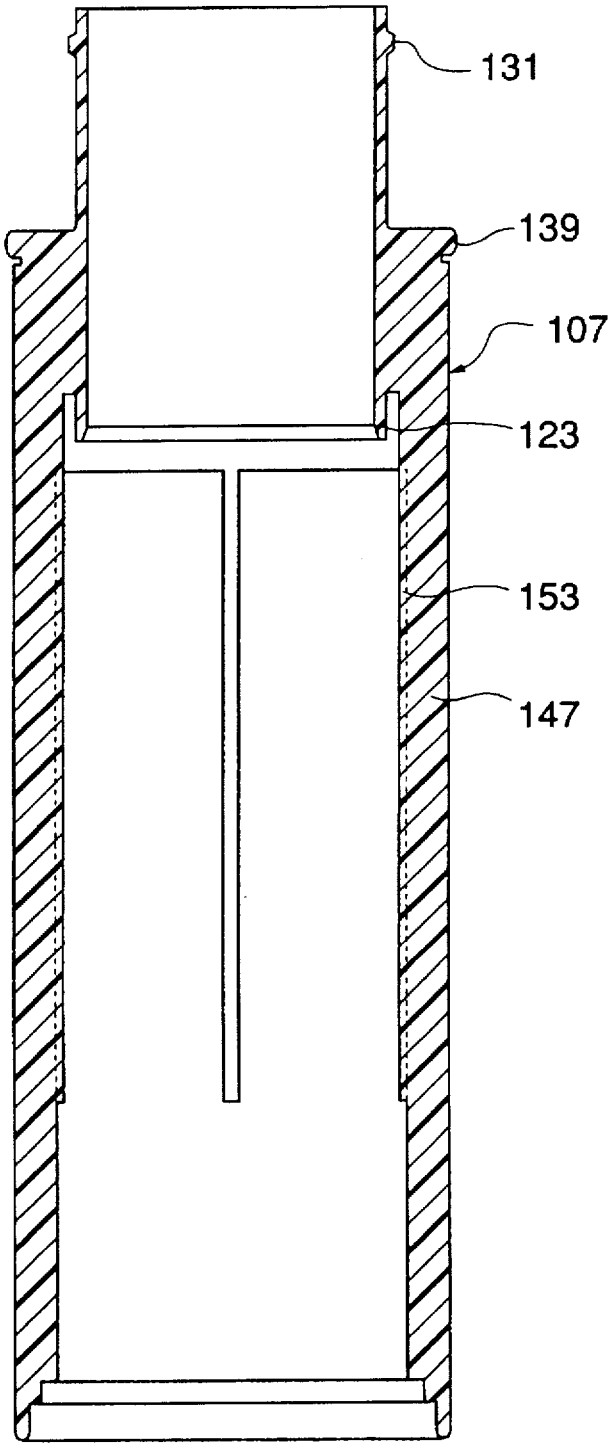
FIG. 28 is a cross-sectional view showing an insert sleeve of the cosmetic container shown in FIG. 27.

FIGS. 27 and 28 show an embodiment in which insert sleeve 107 is formed as a part of casing 147 surrounding outer body 101. In this embodiment, gap G is formed between a bottom 110 of insert sleeve 107 and a top 101*a* of outer body 101. Longitudinally extending projections 153 are formed on the inner peripheral surface of casing 147, which engages with corresponding grooves on the outer peripheral surface of outer body 101 to prevent relative rotation therebetween. The cosmetic container of this embodiment is of a bottom-filling type in which a molten cosmetic is charged into cosmetic holder 113 through a bottom aperture 102 of outer body 101. Cosmetic holder 113 has upper and lower open ends and is provided with a stopper annular projection 155 on the inner peripheral surface thereof.

When insert sleeve 107 is welded to outer body 101 or casing 147, there is no limitation regarding a point or area of welding. For example, the bottom of projection 139 may be welded to the top of upper cutout portion 117.

Figure 29:
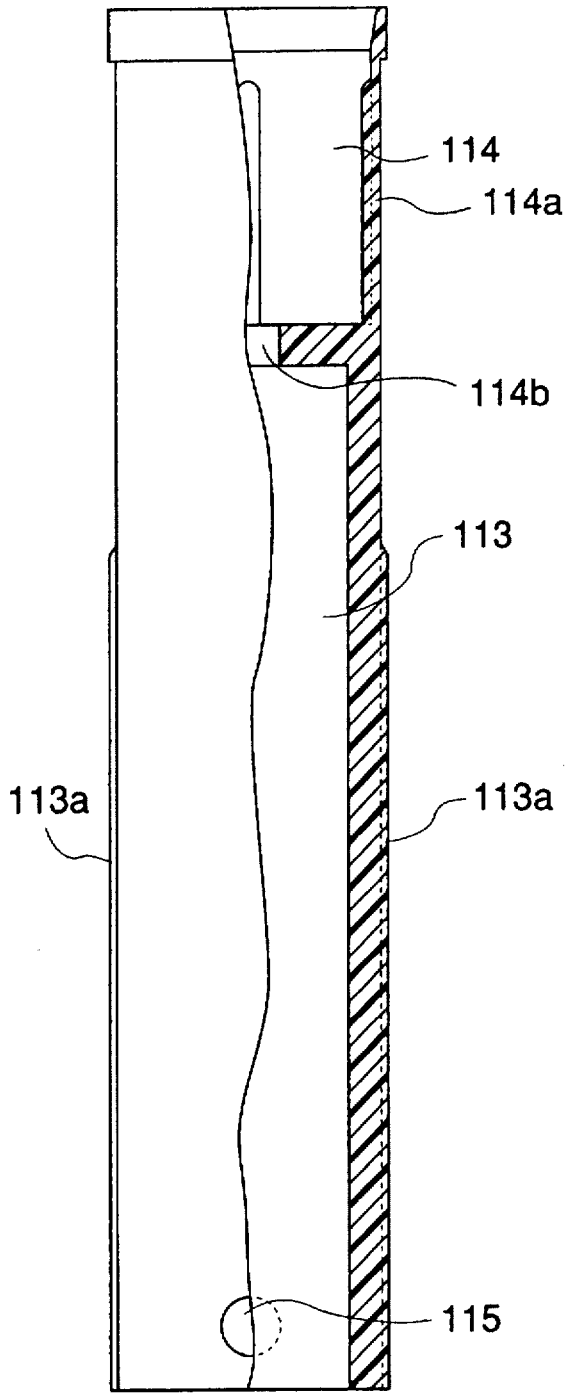
FIG. 29 is a longitudinal cross-sectional view showing still another embodiment of the cosmetic holder.
Figure 30:
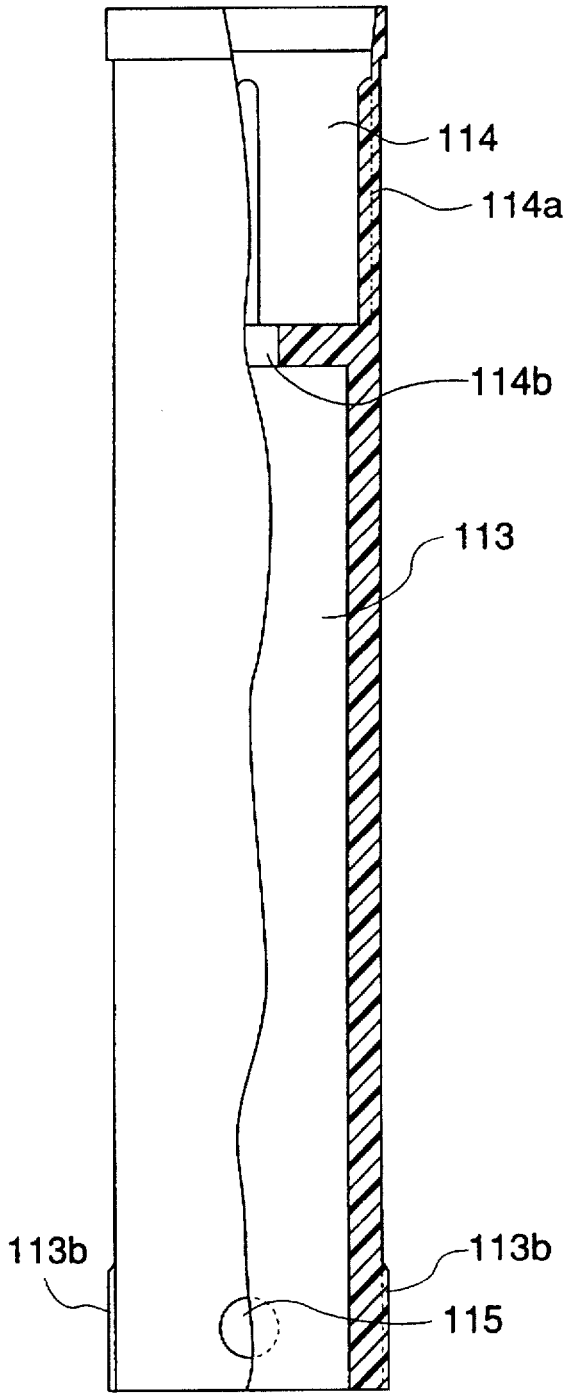
FIG. 30 is a longitudinal cross-sectional view showing still another embodiment of the cosmetic holder.
Figure 31:
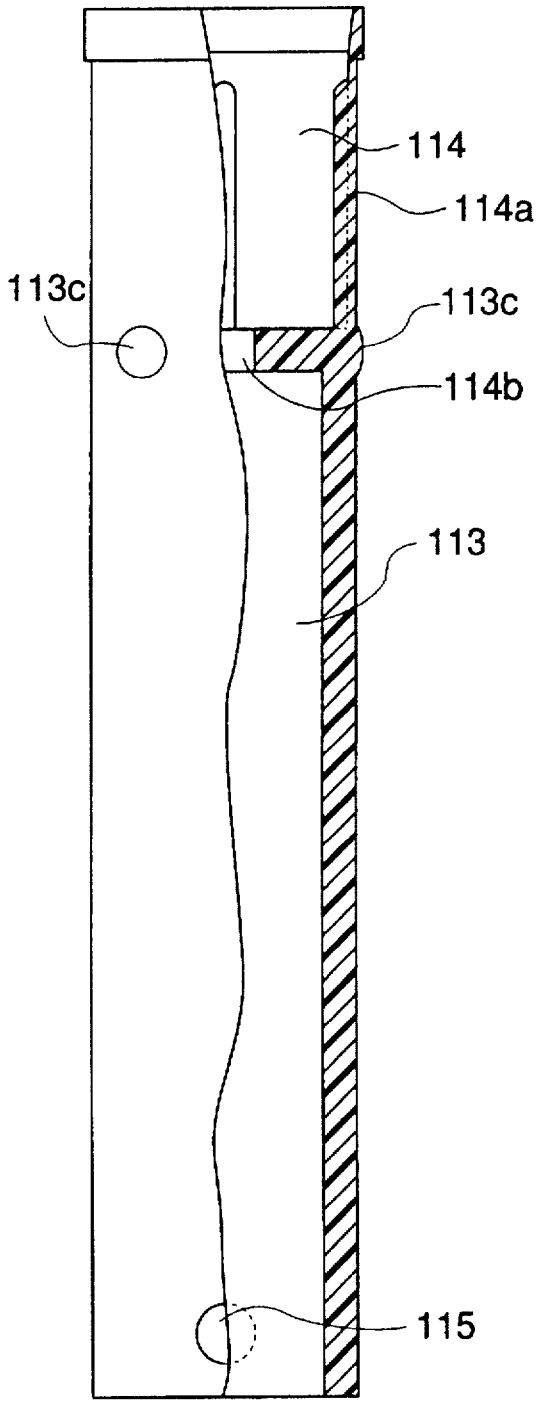
FIG. 31 is a longitudinal cross-sectional view showing still another embodiment of the cosmetic holder.

Cosmetic holder 113 may have desired shape and form. For example, it may be an oval in cross-section. It may be provided with a pair of opposed projections 113*a*, 113*a* extending longitudinally along the outer peripheral surface thereof (FIG. 29). Alternatively, longitudinally extending projections may be positioned only at the lower end of cosmetic holder 113, which are shown as projections 113*b*, 113*b* in FIG. 30. Spaced projections 113*c*, 113*c* may be formed on the outer peripheral surface of the bottom of receptacle 114, as shown in FIG. 31.

Main body 103 may be a pressing pipe formed by pressing a flat plate. However, it is preferable that main body 103 comprises a straight pipe formed by drawing.

Suitable stop means may be employed for preventing relative rotation between adjacent members. For example, the embodiment shown in FIG. 26 includes a rotation-stopper comprising a combination of knurls 149 and grooves 117 for preventing relative rotating between outer body 101 and insert sleeve 107. Another example of rotation-stopper comprises one member having a polygonal cross-sectional outer periphery which is fitted within another member having a corresponding cross-sectional inner periphery. A combination of ribs and slits may be employed. Adjacent members may be secured to each other by adhesive.

The cosmetic container of the present invention may contain any type of stick-like cosmetic such as a lipstick and foundation in a solid, paste, gel or any other form.

The cosmetic container of the present invention may be of an insertion type in which a solid cosmetic is inserted from the above into cosmetic holder, or of a filling type in which a molten cosmetic is filled into a mold located in cosmetic holder from the above (direct-filling type) or through bottom aperture 102 (bottom-filling type). An example of the insertion type container is shown in FIG. 12. An example of the bottom-filling type container is shown in FIG. 27. In the case of the filling type container, after the cosmetic is solidified, the mold is removed and cap 127 is fitted. The bottom aperture is closed by a seal to create an airtight condition inside the container. In the filling type container, longitudinal projections 114*a* of receptacle 114 may be replaced by an annular projection. In the case of the bottom-filling container, there is no aperture 114*b* on the bottom of receptacle 114.

Various cylindrical members including main body 103, insert sleeve 107, outer body 101 and cosmetic holder 113 may have desired diameters, respectively.

Figure 32:
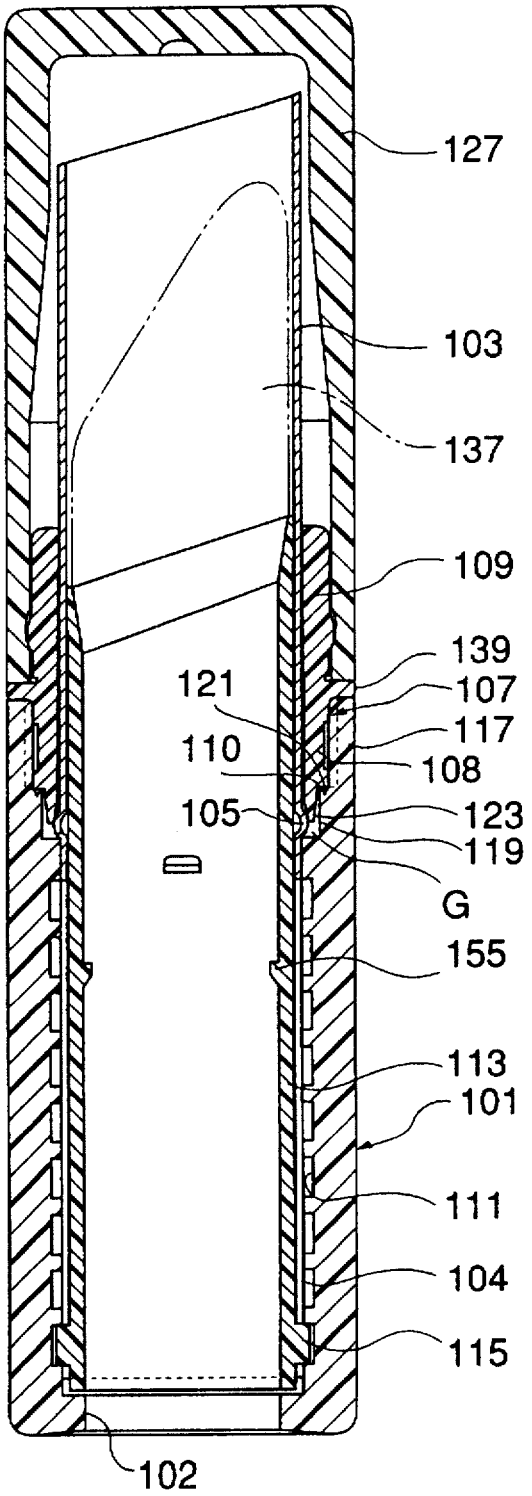
FIG. 32 is a longitudinal cross-sectional view showing still another embodiment of the cosmetic container.

Respective constituents of the cosmetic container of the present invention may be made from suitable material. For example, as in the embodiment of FIG. 25, casing 147 and cap 127 are made of metal such as aluminum, and inner cap 129 fitted within cap 127 is coupled to insert sleeve 107, in which case the cosmetic container has an improved airtightness. When outer body 101, insert sleeve 107 and cap 127 are made of resin, as in the embodiments of FIGS. 12, 19 and 27, airtightness of the cosmetic container is more or less decreased, which can be again increased by connecting integrally insert sleeve 107 and outer body 101 by ultrasonic-welding, for example. The inner cap may not be employed, as in the embodiment of FIG. 32. When outer body 101, insert sleeve 107 and cap 127 are made of resin and cap 127 is directly fitted to insert sleeve 107, the container has a poor airtightness. Main body 103 may be made of resin. Cosmetic holder 113 may be made of polypropylene (PP) in the container of direct-filling and insertion types and polybutylene terephthalate (PBT) in the container of bottom-filling type. Airtightness of the container will vary depending upon material of the constituents.

Detachable coupling means between insert sleeve 107 and inner cap 129 may be a combination of projection(s) on the inner peripheral surface of inner cap 129 and recess(es) on the outer peripheral surface of insert sleeve 107 for receiving the projection(s).

It is to be understood that while the present invention has been described in connection with a limited number of particular examples, no limitation is intended thereby except as defined in the appended claims.

What is claimed is:

1. A cosmetic container comprising: a main body provided at a lower portion thereof with slot means extending in a longitudinal direction; an outer body having an open upper end and being provided with a continuous spiral groove on an inner peripheral surface thereof, said outer body surrounding said main body substantially in close relation to each other but allowing relative rotation therebetween; a cosmetic holder accommodated within said main body substantially in close relation to each other but allowing relative longitudinal sliding movement therebetween, said cosmetic holder being provided with projection means projecting outwardly therefrom through said slot means to be in engagement with said continuous spiral groove so that said cosmetic holder moves longitudinally with respect to said main body in response to rotation of said outer body; an insert sleeve surrounding said main body and arranged fixedly with respect to said outer body; said main body being provided on an outer peripheral surface thereof with an annular projection which contacts with a bottom portion of said insert sleeve and is spaced apart from an inner peripheral surface of the open upper end portion of said outer body.

2. The cosmetic container according to claim 1 wherein said insert sleeve has annular rib means on an inner peripheral surface thereof, said annular rib means contacting with an outer peripheral surface of said main body and providing a gap between said insert sleeve and said main body.

3. The cosmetic container according to claim 1 wherein said annular rib is formed as an endless continuously extending rib.

4. The cosmetic container according to claim 1 wherein said cosmetic holder has an oval cross-section.

5. The cosmetic container according to claim 1 wherein said cosmetic holder is provided on an outer peripheral surface thereof with a pair of opposed projections extending in a longitudinal direction.

6. The cosmetic container according to claim 5 wherein said projections extend from below said annular projection of said main body to a bottom end of said cosmetic holder.

7. The cosmetic container according to claim 1 wherein said insert sleeve is provided on an outer peripheral surface thereof with an annular projection for detachably engaging with an annular recess formed on an inner peripheral surface of a cap.

8. The cosmetic container according to claim 1 wherein said insert sleeve is provided on an outer peripheral surface thereof with an annular projection for detachably engaging with another annular projection formed on an inner peripheral surface of a cap.

9. The cosmetic container according to claim 1 wherein said insert sleeve has a longitudinal wall slit.

10. The cosmetic container according to claim 1 wherein a cap is detachably fitted to said main body.

11. The cosmetic container according to claim 1 wherein an inner cap is fitted within a cap, and said insert sleeve is provided on an outer peripheral surface thereof with an annular projection for detachably engaging with an annular recess formed on an inner peripheral surface of said inner cap.

12. The cosmetic container according to claim 1 wherein an inner cap, fitted within a cap, is detachably fitted to said main body.

13. The cosmetic container according to claim 1 wherein said insert sleeve is welded to the upper end portion of said outer body.

14. The cosmetic container according to claim 1 wherein said insert sleeve is formed as an integral part of said outer body.

15. A cosmetic container comprising: a main body provided at a lower portion thereof with slot means extending in a longitudinal direction; an outer body provided with a continuous spiral groove on an inner peripheral surface thereof, said outer body surrounding the main body substantially in close relation to each other but allowing relative rotation therebetween; a cosmetic holder accommodated within said main body substantially in close relation to each other but allowing relative longitudinal sliding movement therebetween, said cosmetic holder being provided with projection means projecting outwardly therefrom through said slot means to be in engagement with said continuous spiral groove so that said cosmetic holder moves longitudinally with respect to said main body in response to rotation of said outer body; an insert sleeve surrounding said main body and arranged unrotatably with respect to said outer body; an inner peripheral surface of the upper end portion of said outer body being partly cut out to form at least a cutout portion; said insert sleeve having an integral downwardly extending tongue positioned inside of said cutout portion with a gap therebetween, said tongue contacting elastically with an annular projection formed on an outer peripheral surface of said main body.

16. The cosmetic container according to claim 15 wherein said tongue is in linear contact with said annular projection of said main body.

17. The cosmetic container according to claim 15 wherein said said tongue is formed as an endless ring.

18. The cosmetic container according to claim 15 wherein said tongue is formed as a ring with longitudinal slit or slits.

19. The cosmetic container according to claim 15 wherein said insert sleeve is provided on an inner peripheral surface thereof annular rib means for rotatably contacting with said main body.

20. The cosmetic container according to claim 19 wherein said annular rib means is an endless continuous projection.

21. The cosmetic container according to claim 19 wherein said annular rib means is formed as a series of spaced dot-like projections.

22. The cosmetic container according to claim 15 wherein a ring member is disposed below said tongue, said ring member and said tongue surrounding and elastically contacting with said annular projection of said main body.

23. The cosmetic container according to claim 22 wherein said ring member is made of elastic material.

24. The cosmetic container according to claim 22 wherein said ring member has a cutout portion to facilitate its elastic deformation.

25. The cosmetic container according to claim 15 wherein said insert sleeve is welded to the upper end portion of said outer body.

26. The cosmetic container according to claim 15 wherein said insert sleeve formed as an integral part of said outer body.

* * * * *

UNITED STATES PATENT AND TRADEMARK OFFICE

CERTIFICATE OF CORRECTION

PATENT NO : 5,749,664

DATED : May 12, 1998

INVENTOR(S) : Takashi Inoue, et al.

It is certified that error appears in the above-identified patent and that said Letters Patent is hereby corrected as shown below:

Claims 1-4 should read as follows:

1. A cosmetic container comprising: a main body provided at a lower portion thereof with slot means extending in a longitudinal direction; an outer body having an open upper end and being provided with a continuous spiral groove on an inner peripheral surface thereof, said outer body surrounding said main body substantially in close relation to each other but allowing relative rotation therebetween; a cosmetic holder accommodated within said main body substantially in close relation to each other but allowing relative longitudinal sliding movement therebetween, said cosmetic holder being provided with projection means projecting outwardly therefrom through said slot means to be in engagement with said continuous spiral groove so that said cosmetic holder moves longitudinally with respect to said main body in response to rotation of said outer body; an insert sleeve surrounding said main body and arranged fixedly with respect to said outer body; said main body being provided on an outer peripheral surface thereof with an annular projection which contacts with a It is certified that error appears in the above-identified patent and that said Letters Patent is hereby corrected as shown below:

bottom portion of said insert sleeve and is spaced apart from an inner peripheral surface of the open upper end portion of said outer body, wherein said insert sleeve has annular rib means on an inner peripheral surface thereof, said annular rib means contacting with an outer peripheral surface of said main body and providing a gap between said insert sleeve and said main body.

2. The cosmetic container according to claim 1 wherein said annular rib means is formed as a series of spaced dot-like projections.

3. The cosmetic container according to claim 1 wherein said annular rib is formed as an endless continuously extending rib.

4. The cosmetic container according to claim 1 wherein said cosmetic holder has an oval cross-section.

UNITED STATES PATENT AND TRADEMARK OFFICE

CERTIFICATE OF CORRECTION

PATENT NO. : 5,749,664

DATED : May 12, 1998

INVENTOR(S) : Takashi Inoue, et al

It is certified that error appears in the above-identified patent and that said Letters Patent is hereby corrected as shown below:

Column 13, line 3, "rotation" should read -- rotating --.

Column 13, line 4, "an" should read -- and --.

Signed and Sealed this

Twenty-seventh Day of April, 1999

*Attest:*

Q. TODD DICKINSON

*Attesting Officer*

*Acting Commissioner of Patents and Trademarks*